US009101820B2

(12) United States Patent
Soltys

(10) Patent No.: US 9,101,820 B2
(45) Date of Patent: Aug. 11, 2015

(54) SYSTEM, METHOD AND APPARATUS TO PRODUCE DECKS FOR AND OPERATE GAMES PLAYED WITH PLAYING CARDS

(75) Inventor: Richard Soltys, Mercer Island, WA (US)

(73) Assignee: Bally Gaming, Inc., Las Vegas, NV (US)

( * ) Notice: Subject to any disclaimer, the term of this patent is extended or adjusted under 35 U.S.C. 154(b) by 2376 days.

(21) Appl. No.: 11/558,409

(22) Filed: Nov. 9, 2006

(65) Prior Publication Data

US 2008/0113764 A1 May 15, 2008

(51) Int. Cl.

| | |
|---|---|
| ***A63F 1/00*** | (2006.01) |
| ***A63F 1/12*** | (2006.01) |
| *A63F 3/00* | (2006.01) |

(52) U.S. Cl.

CPC ... *A63F 1/00* (2013.01); *A63F 1/12* (2013.01); *A63F 3/00157* (2013.01)

(58) Field of Classification Search

CPC ..... G06F 17/3227; G06F 17/3267
USPC ..... 463/11, 21, 12, 19, 22; 273/292, 304
See application file for complete search history.

(56) References Cited

U.S. PATENT DOCUMENTS

| | | | | |
|---|---|---|---|---|
| 2,567,223 | A | 9/1951 | Maher et al. | |
| 2,731,271 | A | 1/1956 | Brown | 273/149 |
| 3,222,071 | A | 12/1965 | Lang | 273/149 |
| 3,312,473 | A | 4/1967 | Friedman et al. | 273/149 |
| 3,339,223 | A | 9/1967 | Laby | 16/105 |
| 3,377,070 | A | 4/1968 | Nottoli | 273/149 |
| 3,493,728 | A | 2/1970 | Braden et al. | 235/61.11 |
| 3,561,756 | A | 2/1971 | Barnett | 271/41 |
| 3,690,670 | A | 9/1972 | Cassady et al. | 273/149 P |
| 3,735,982 | A | 5/1973 | Gerfin | 273/1 E |
| 3,752,962 | A | 8/1973 | Greskovics | 235/61.11 |
| 3,799,553 | A | 3/1974 | Hurley | |
| 3,897,954 | A | 8/1975 | Erickson et al. | 273/149 R |
| 3,907,282 | A | 9/1975 | Hunter | 271/233 |
| 3,929,339 | A | 12/1975 | Mattioli | 273/148 A |
| 3,937,311 | A | 2/1976 | Gehrke | 192/45 |
| 3,937,312 | A | 2/1976 | Gehrke | 192/45 |
| 3,942,616 | A | 3/1976 | Elmore | 192/45 |
| 3,972,573 | A | 8/1976 | Marola | 308/217 |

(Continued)

FOREIGN PATENT DOCUMENTS

| | | |
|---|---|---|
| DE | 199 40 954 | 3/2001 |
| EP | 0 700 980 B1 | 11/1999 |

(Continued)

OTHER PUBLICATIONS

U.S. Appl. No. 10/885,875, filed Jul. 7, 2004, Soltys et al.

(Continued)

*Primary Examiner* — Damon Pierce
*Assistant Examiner* — Allen Chan
(74) *Attorney, Agent, or Firm* — Frank Abramonte; Marvin Hein

(57) ABSTRACT

A composition of a set of playing cards employing a plurality of standard playing cards and bonus playing cards may be determined, resulting in a desired theoretical hold or advantage for the gaming establishment. The composition identifies the number of each of a variety of bonus playing cards to include in a set of playing cards to achieve the theoretical hold. The composition may be based on a desired theoretical hold, rule(s), and/or bonus parameters.

11 Claims, 14 Drawing Sheets

(56) References Cited

U.S. PATENT DOCUMENTS

| | | | | |
|---|---|---|---|---|
| 3,990,555 | A | 11/1976 | Carullo | 192/45 |
| 3,993,176 | A | 11/1976 | Marola et al. | 192/45 |
| 3,993,177 | A | 11/1976 | Gehrke | 192/45 |
| 3,994,377 | A | 11/1976 | Elmore | 192/45 |
| 4,031,376 | A | 6/1977 | Corkin, Jr. | 235/156 |
| 4,241,921 | A | 12/1980 | Miller | 273/148 A |
| 4,244,582 | A | 1/1981 | Raees et al. | 273/293 |
| 4,310,160 | A | 1/1982 | Willette et al. | 273/149 R |
| 4,339,798 | A | 7/1982 | Hedges et al. | 364/412 |
| 4,448,419 | A | 5/1984 | Telnaes | 273/143 R |
| 4,457,512 | A | 7/1984 | Stevenson | 273/148 |
| 4,497,488 | A | 2/1985 | Plevyak et al. | 273/149 R |
| 4,512,580 | A | 4/1985 | Matviak | 273/148 A |
| 4,531,909 | A | 7/1985 | Takeshita | 432/37 |
| 4,534,562 | A | 8/1985 | Cuff et al. | 273/149 P |
| 4,586,712 | A | 5/1986 | Lorber et al. | 273/149 R |
| 4,635,937 | A | 1/1987 | Dickinson et al. | 273/143 R |
| 4,659,082 | A | 4/1987 | Greenberg | 273/149 R |
| 4,660,833 | A | 4/1987 | Dickinson et al. | 273/143 R |
| 4,662,637 | A | 5/1987 | Pfeiffer | 273/149 P |
| 4,667,959 | A | 5/1987 | Pfeiffer et al. | 273/149 R |
| 4,693,477 | A | 9/1987 | Dickinson et al. | 273/143 R |
| 4,711,452 | A | 12/1987 | Dickinson et al. | 273/143 R |
| 4,721,307 | A | 1/1988 | Okada | 273/143 R |
| 4,750,743 | A | 6/1988 | Nicoletti | 273/148 A |
| 4,770,421 | A | 9/1988 | Hoffman | 273/149 R |
| 4,807,884 | A | 2/1989 | Breeding | 273/149 R |
| 4,822,050 | A | 4/1989 | Normand et al. | 273/149 P |
| 4,832,342 | A | 5/1989 | Plevyak et al. | 273/149 R |
| 4,837,728 | A | 6/1989 | Barrie et al. | 364/412 |
| 4,861,041 | A | 8/1989 | Jones et al. | 273/292 |
| 4,885,700 | A | 12/1989 | Kondziolka et al. | 364/519 |
| 4,926,996 | A | 5/1990 | Eglise et al. | 194/212 |
| 4,951,950 | A | 8/1990 | Normand et al. | 273/149 P |
| 4,969,648 | A | 11/1990 | Hollinger et al. | 273/149 R |
| 4,995,615 | A | 2/1991 | Cheng | 273/292 |
| 4,998,737 | A | 3/1991 | Lamle | 273/296 |
| 5,000,453 | A | 3/1991 | Stevens et al. | 273/149 R |
| 5,007,649 | A | 4/1991 | Richardson | |
| 5,050,881 | A | 9/1991 | Nagao | 273/143 R |
| 5,058,893 | A | 10/1991 | Dickinson et al. | 273/143 R |
| 5,067,713 | A | 11/1991 | Soules et al. | 273/149 P |
| 5,083,800 | A | 1/1992 | Lockton | 273/439 |
| 5,096,197 | A | 3/1992 | Embury | 273/149 R |
| 5,100,137 | A | 3/1992 | Fulton | 273/85 CP |
| 5,114,153 | A | 5/1992 | Rosenwinkel et al. | 273/292 |
| 5,121,921 | A | 6/1992 | Friedman et al. | 273/149 P |
| 5,152,529 | A | 10/1992 | Okada | 273/143 R |
| 5,157,602 | A | 10/1992 | Fields et al. | 364/412 |
| 5,167,413 | A | 12/1992 | Fulton | 273/85 CP |
| 5,186,464 | A | 2/1993 | Lamle | 273/149 R |
| 5,199,710 | A | 4/1993 | Lamle | 273/149 R |
| 5,240,140 | A | 8/1993 | Huen | 221/13 |
| 5,242,163 | A | 9/1993 | Fulton | 273/85 CP |
| 5,248,142 | A | 9/1993 | Breeding | 273/138 R |
| 5,251,897 | A | 10/1993 | Fulton | 273/85 CP |
| 5,261,667 | A | 11/1993 | Breeding | 273/149 R |
| 5,275,400 | A | 1/1994 | Weingardt et al. | 273/85 CP |
| 5,275,411 | A | 1/1994 | Breeding | 273/149 R |
| 5,303,921 | A | 4/1994 | Breeding | 273/149 R |
| 5,321,241 | A | 6/1994 | Craine | 235/380 |
| 5,324,035 | A | 6/1994 | Morris et al. | 273/138 A |
| 5,326,104 | A | 7/1994 | Pease et al. | 273/138 A |
| 5,332,219 | A | 7/1994 | Marnell, II et al. | 273/138 A |
| 5,344,144 | A | 9/1994 | Canon | 273/138 A |
| 5,344,146 | A | 9/1994 | Lee | 273/149 R |
| 5,356,145 | A | 10/1994 | Verschoor | 273/149 R |
| 5,361,885 | A | 11/1994 | Modler | 194/214 |
| 5,364,104 | A | 11/1994 | Jones et al. | 273/292 |
| 5,382,024 | A | 1/1995 | Blaha | 273/149 R |
| 5,393,067 | A | 2/1995 | Paulsen et al. | 273/292 |
| 5,395,111 | A | 3/1995 | Inoue | 273/143 R |
| 5,397,133 | A | 3/1995 | Penzias | 273/439 |
| 5,398,932 | A | 3/1995 | Eberhardt et al. | 273/138 A |
| 5,411,257 | A | 5/1995 | Fulton | 273/85 CP |
| 5,417,430 | A | 5/1995 | Breeding | 273/292 |
| 5,431,399 | A | 7/1995 | Kelley | 273/149 P |
| 5,431,408 | A | 7/1995 | Adams | 273/306 |
| 5,437,451 | A | 8/1995 | Fulton | 273/138 A |
| 5,445,377 | A | 8/1995 | Steinbach | 273/149 R |
| 5,472,194 | A | 12/1995 | Breeding et al. | 273/138 A |
| 5,487,544 | A | 1/1996 | Clapper, Jr. | 273/138 A |
| 5,505,449 | A | 4/1996 | Eberhardt et al. | 273/138 A |
| 5,511,784 | A | 4/1996 | Furry et al. | 273/143 R |
| 5,513,851 | A | 5/1996 | Harris | 273/274 |
| 5,544,892 | A | 8/1996 | Breeding | 273/292 |
| 5,544,893 | A | 8/1996 | Jones et al. | 273/309 |
| 5,562,284 | A | 10/1996 | Stevens | 273/139 |
| 5,570,885 | A | 11/1996 | Ornstein | 463/27 |
| 5,575,475 | A | 11/1996 | Steinbach | 273/149 R |
| 5,584,483 | A | 12/1996 | Sines et al. | 273/149 R |
| 5,584,764 | A | 12/1996 | Inoue | 463/20 |
| 5,605,334 | A | 2/1997 | McCrea, Jr. | 273/309 |
| 5,605,504 | A | 2/1997 | Huang | 463/22 |
| 5,605,506 | A | 2/1997 | Hoorn et al. | 463/47 |
| 5,609,524 | A | 3/1997 | Inoue | 463/20 |
| 5,613,912 | A | 3/1997 | Slater | 463/25 |
| 5,636,842 | A | 6/1997 | Cabot et al. | 273/292 |
| 5,636,843 | A | 6/1997 | Roberts | 273/292 |
| 5,643,086 | A | 7/1997 | Alcorn et al. | 463/29 |
| 5,645,486 | A | 7/1997 | Nagao et al. | 463/27 |
| 5,653,635 | A | 8/1997 | Breeding | 463/11 |
| 5,655,961 | A | 8/1997 | Acres et al. | 463/27 |
| 5,669,816 | A | 9/1997 | Garczynski et al. | 463/12 |
| 5,676,372 | A | 10/1997 | Sines et al. | 273/149 R |
| 5,683,085 | A | 11/1997 | Johnson et al. | 273/149 R |
| 5,685,543 | A | 11/1997 | Garner | 273/148 A |
| 5,685,774 | A | 11/1997 | Webb | 463/13 |
| 5,690,324 | A | 11/1997 | Otomo et al. | 270/58.02 |
| 5,692,748 | A | 12/1997 | Frisco et al. | 273/149 R |
| 5,695,189 | A | 12/1997 | Breeding et al. | 273/149 R |
| 5,702,302 | A | 12/1997 | Gauselmann | 463/20 |
| 5,704,835 | A | 1/1998 | Dietz, II | 463/20 |
| 5,707,287 | A | 1/1998 | McCrea, Jr. | 463/27 |
| 5,711,525 | A | 1/1998 | Breeding | 273/292 |
| 5,718,427 | A | 2/1998 | Cranford et al. | 273/149 R |
| 5,722,891 | A | 3/1998 | Inoue | 463/20 |
| 5,735,525 | A | 4/1998 | McCrea, Jr. | 273/309 |
| 5,741,183 | A | 4/1998 | Acres et al. | 463/42 |
| 5,743,800 | A | 4/1998 | Huard et al. | |
| 5,745,110 | A | 4/1998 | Ertemalp | 345/340 |
| 5,752,881 | A | 5/1998 | Inoue | 463/20 |
| 5,759,102 | A | 6/1998 | Pease et al. | 463/42 |
| 5,766,074 | A | 6/1998 | Cannon et al. | 463/16 |
| 5,766,075 | A | 6/1998 | Cook et al. | |
| 5,766,076 | A | 6/1998 | Pease et al. | 463/27 |
| 5,769,458 | A | 6/1998 | Carides et al. | 283/102 |
| 5,770,533 | A | 6/1998 | Franchi | 463/42 |
| 5,775,692 | A | 7/1998 | Watts et al. | 273/143 R |
| 5,779,545 | A | 7/1998 | Berg et al. | 463/22 |
| 5,788,573 | A | 8/1998 | Baerlocher et al. | 463/16 |
| 5,788,574 | A | 8/1998 | Ornstein et al. | 463/25 |
| 5,794,964 | A | 8/1998 | Jones et al. | 273/309 |
| 5,795,225 | A | 8/1998 | Jones et al. | 463/13 |
| 5,800,268 | A | 9/1998 | Molnick | 463/40 |
| 5,803,453 | A | 9/1998 | Stephan et al. | |
| 5,803,809 | A | 9/1998 | Yoseloff | 463/13 |
| 5,813,912 | A | 9/1998 | Shultz | 463/25 |
| 5,816,918 | A | 10/1998 | Kelly et al. | |
| 5,820,460 | A | 10/1998 | Fulton | 463/13 |
| 5,823,534 | A | 10/1998 | Banyai | 273/269 |
| 5,823,874 | A | 10/1998 | Adams | 463/17 |
| 5,823,879 | A | 10/1998 | Goldberg et al. | 463/42 |
| 5,830,064 | A | 11/1998 | Bradish et al. | 463/22 |
| 5,830,067 | A | 11/1998 | Graves et al. | 463/40 |
| 5,830,068 | A | 11/1998 | Brenner et al. | 463/42 |
| 5,836,586 | A | 11/1998 | Marks et al. | 273/292 |
| 5,839,730 | A | 11/1998 | Pike | 273/292 |
| 5,842,921 | A | 12/1998 | Mindes et al. | 463/16 |
| 5,848,932 | A | 12/1998 | Adams | 463/20 |
| 5,851,011 | A | 12/1998 | Lott | 273/292 |
| 5,851,148 | A | 12/1998 | Brune et al. | 463/25 |
| 5,851,149 | A | 12/1998 | Xidos et al. | 463/42 |
| 5,855,515 | A | 1/1999 | Pease et al. | 463/27 |

(56) References Cited

U.S. PATENT DOCUMENTS 5,863,249 A 1/1999 Inoue ..... 463/20
5,867,586 A 2/1999 Liang ..... 382/112
5,871,213 A 2/1999 Chadband et al. ..... 273/292
5,871,400 A 2/1999 Yfantis ..... 463/22
5,882,261 A 3/1999 Adams ..... 463/20
5,885,158 A 3/1999 Torango et al. ..... 463/27
5,890,963 A 4/1999 Yen ..... 463/42
5,895,451 A 4/1999 Yamade et al.
5,905,847 A 5/1999 Kobayashi et al.
5,911,418 A 6/1999 Adams ..... 273/274
5,911,419 A 6/1999 Delaney et al. ..... 273/292
5,911,626 A 6/1999 McCrea, Jr. ..... 463/27
5,919,091 A 7/1999 Bell et al. ..... 463/25
5,934,866 A 8/1999 Redden ..... 414/798.9
5,934,999 A 8/1999 Valdez ..... 463/17
5,941,771 A 8/1999 Haste, III ..... 463/17
5,944,310 A 8/1999 Johnson et al. ..... 273/149 R
5,947,820 A 9/1999 Morro et al. ..... 463/9
5,957,776 A 9/1999 Hoehne ..... 463/25
5,967,893 A 10/1999 Lawrence et al. ..... 463/10
5,967,894 A 10/1999 Kinoshita et al. ..... 463/13
5,971,851 A 10/1999 Pascal et al. ..... 463/24
5,974,135 A 10/1999 Breneman et al.
5,984,782 A 11/1999 Inoue ..... 463/20
5,989,122 A 11/1999 Roblejo ..... 463/22
5,999,808 A 12/1999 LaDue ..... 455/412
6,001,016 A 12/1999 Walker et al. ..... 463/42
6,003,013 A 12/1999 Boushy et al.
6,003,867 A 12/1999 Rodesch et al. ..... 273/143 R
6,004,205 A 12/1999 Lauretta et al. ..... 463/11
6,004,207 A 12/1999 Wilson, Jr. et al. ..... 463/20
6,010,404 A 1/2000 Walker et al. ..... 463/21
6,019,368 A 2/2000 Sines et al. ..... 273/149 R
6,019,374 A 2/2000 Breeding ..... 273/292
6,027,115 A 2/2000 Griswold et al. ..... 273/143 R
6,032,955 A 3/2000 Luciano et al. ..... 273/138.1
6,045,130 A 4/2000 Jones et al. ..... 273/292
6,047,322 A 4/2000 Vaid et al.
6,056,641 A 5/2000 Webb ..... 463/13
6,059,289 A 5/2000 Vancura ..... 273/143 R
6,062,565 A 5/2000 Chadband et al. ..... 273/292
6,062,981 A 5/2000 Luciano, Jr. ..... 463/26
6,066,439 A 5/2000 Nohr et al. ..... 430/347
6,068,258 A 5/2000 Breeding et al. ..... 273/149 R
6,068,552 A 5/2000 Walker et al. ..... 463/21
6,068,553 A 5/2000 Parker ..... 463/27
6,070,878 A 6/2000 Jones et al. ..... 273/309
6,077,161 A 6/2000 Wisler ..... 463/11
6,080,063 A 6/2000 Khosla ..... 463/42
6,089,978 A 7/2000 Adams ..... 463/20
6,089,980 A 7/2000 Gauselmann ..... 463/27
6,093,103 A 7/2000 McCrea, Jr. ..... 463/27
6,099,407 A 8/2000 Parker, Jr. et al. ..... 463/19
6,102,799 A 8/2000 Stupak ..... 463/27
6,105,962 A 8/2000 Malavazos et al. ..... 273/143 R
6,105,964 A 8/2000 Maahs ..... 273/292
6,110,041 A 8/2000 Walker et al. ..... 463/20
6,110,043 A 8/2000 Olsen ..... 463/27
6,113,098 A 9/2000 Adams ..... 273/143 R
6,113,492 A 9/2000 Walker et al. ..... 463/16
6,117,009 A 9/2000 Yoseloff ..... 463/20
6,117,012 A 9/2000 McCrea, Jr. ..... 463/27
6,120,377 A 9/2000 McGinnis, Sr. et al. ..... 463/20
6,120,588 A 9/2000 Jacobson ..... 106/31.16
6,123,333 A 9/2000 McGinnis, Sr. et al. ..... 273/146
6,126,542 A 10/2000 Fier ..... 463/16
6,135,453 A 10/2000 Srichayaporn ..... 273/292
6,135,887 A 10/2000 Pease et al. ..... 463/42
6,139,014 A 10/2000 Breeding et al. ..... 273/149 R
6,146,273 A 11/2000 Olsen ..... 463/27
6,149,154 A 11/2000 Grauzer et al. ..... 273/149 R
6,149,522 A 11/2000 Alcorn et al. ..... 463/29
6,152,822 A 11/2000 Herbert ..... 463/22
6,152,824 A 11/2000 Rothschild et al. ..... 463/42
6,155,925 A 12/2000 Giobbi et al.
6,159,096 A 12/2000 Yoseloff ..... 463/20
6,161,476 A 12/2000 Yoneoka ..... 101/118
6,162,121 A 12/2000 Morro et al. ..... 463/16
6,165,070 A 12/2000 Nolte et al. ..... 463/20
6,165,071 A 12/2000 Weiss
6,168,520 B1 1/2001 Baerlocher et al. ..... 463/16
6,168,523 B1 1/2001 Piechowiak et al. ..... 463/26
6,179,711 B1 1/2001 Yoseloff ..... 463/25
6,183,366 B1 2/2001 Goldberg et al. ..... 463/42
6,185,184 B1 2/2001 Mattaway et al.
6,186,892 B1 2/2001 Frank et al. ..... 463/19
6,186,894 B1 2/2001 Mayeroff ..... 463/20
6,186,895 B1 2/2001 Oliver ..... 463/25
6,193,607 B1 2/2001 Kay ..... 463/22
6,196,547 B1 3/2001 Pascal et al. ..... 273/292
6,203,430 B1 3/2001 Walker et al. ..... 463/20
6,210,275 B1 4/2001 Olsen ..... 463/16
6,210,277 B1 4/2001 Stefan ..... 463/27
6,213,877 B1 4/2001 Walker et al. ..... 463/26
6,217,447 B1 4/2001 Lofink et al. ..... 463/12
6,219,836 B1 4/2001 Wells et al. ..... 717/11
6,220,959 B1 4/2001 Holmes, Jr. et al. ..... 463/13
6,224,483 B1 5/2001 Mayeroff ..... 463/20
6,224,484 B1 5/2001 Okuda et al. ..... 463/27
6,227,969 B1 5/2001 Yoseloff ..... 463/13
6,227,971 B1 5/2001 Weiss ..... 463/20
6,227,972 B1 5/2001 Walker et al. ..... 463/25
6,234,898 B1 5/2001 Belamant et al. ..... 463/25
6,244,958 B1 6/2001 Acres ..... 463/26
6,250,632 B1 6/2001 Albrecht ..... 273/149 R
6,251,014 B1 6/2001 Stockdale et al. ..... 463/16
6,254,096 B1 7/2001 Grauzer et al. ..... 273/149 R
6,254,483 B1 7/2001 Acres
6,254,484 B1 7/2001 McCrea, Jr. ..... 463/27
6,256,651 B1 7/2001 Tuli
6,264,561 B1 7/2001 Saffari et al. ..... 463/42
6,267,248 B1 7/2001 Johnson et al. ..... 209/547
6,273,424 B1 8/2001 Breeding ..... 273/292
6,276,267 B1 8/2001 Yoneoka ..... 101/114
6,287,202 B1 9/2001 Pascal et al. ..... 463/42
6,290,603 B1 9/2001 Luciano, Jr. ..... 463/25
6,293,546 B1 9/2001 Hessing et al. ..... 273/138.2
6,293,864 B1 9/2001 Romero ..... 463/12
6,299,167 B1 10/2001 Sines et al. ..... 273/149 R
6,299,170 B1 10/2001 Yoseloff ..... 273/292
6,302,793 B1 10/2001 Fertitta, III et al.
6,309,300 B1 10/2001 Glavich ..... 463/26
6,311,976 B1 11/2001 Yoseloff et al. ..... 273/138.2
6,312,332 B1 11/2001 Walker et al.
6,312,334 B1 11/2001 Yoseloff ..... 463/25
6,315,664 B1 11/2001 Baerlocher et al. ..... 463/21
6,318,721 B1 11/2001 Randall et al. ..... 273/148 R
6,319,125 B1 * 11/2001 Acres ..... 463/25
6,322,078 B1 11/2001 Adams ..... 273/292
6,325,373 B1 12/2001 Breeding et al. ..... 273/149 R
6,328,649 B1 12/2001 Randall et al. ..... 463/20
6,334,614 B1 1/2002 Breeding ..... 273/292
6,334,814 B1 1/2002 Adams ..... 463/20
6,336,863 B1 1/2002 Baerlocher et al. ..... 463/27
6,346,043 B1 2/2002 Colin et al. ..... 463/17
6,346,044 B1 2/2002 McCrea, Jr. ..... 463/27
6,358,146 B1 3/2002 Adams ..... 463/20
6,361,044 B1 3/2002 Block et al. ..... 273/149 R
6,362,836 B1 3/2002 Shaw et al.
6,364,767 B1 4/2002 Brossard et al. ..... 463/20
6,371,482 B1 4/2002 Hall, Jr. ..... 273/138.1
6,375,187 B1 4/2002 Baerlocher ..... 273/143 R
6,375,569 B1 4/2002 Acres
6,375,570 B1 4/2002 Poole ..... 463/31
6,380,953 B1 4/2002 Mizuno
6,383,076 B1 5/2002 Tiedeken ..... 463/40
6,386,973 B1 5/2002 Yoseloff ..... 463/13
6,389,126 B1 5/2002 Bjornberg et al.
6,394,900 B1 5/2002 McGlone et al. ..... 463/20
6,394,902 B1 5/2002 Glavich et al. ..... 463/20
6,398,220 B1 6/2002 Inoue ..... 273/142 R
6,400,272 B1 6/2002 Holtzman et al. ..... 340/572.1
6,401,099 B1 6/2002 Koppolu et al.
6,406,023 B1 6/2002 Rowe ..... 273/292

(56) References Cited

U.S. PATENT DOCUMENTS 6,406,369 B1 6/2002 Baerlocher et al. ..... 463/20
6,409,602 B1 6/2002 Wiltshire et al. ..... 463/42
6,413,161 B1 7/2002 Baerlocher et al. ..... 463/20
6,413,162 B1 7/2002 Baerlocher et al. ..... 463/20
6,416,408 B2 7/2002 Tracy et al. ..... 463/16
6,419,583 B1 7/2002 Crumby et al. ..... 463/42
6,425,824 B1 7/2002 Baerlocher et al. ..... 463/16
6,439,425 B1 8/2002 Masek ..... 221/241
6,439,995 B1 8/2002 Hughs-Baird et al. ..... 463/20
6,443,452 B1 9/2002 Brune ..... 273/143 R
6,443,839 B2 9/2002 Stockdale et al. ..... 463/16
6,454,266 B1 9/2002 Breeding et al. ..... 273/292
6,459,882 B1 10/2002 Palermo
6,460,848 B1 10/2002 Soltys et al. ..... 273/149 R
6,461,241 B1 10/2002 Webb et al. ..... 463/20
6,464,581 B1 10/2002 Yoseloff et al. ..... 463/20
6,464,582 B1 10/2002 Baerlocher et al. ..... 463/20
6,464,584 B2 10/2002 Oliver ..... 463/25
6,468,156 B1 10/2002 Hughs-Baird et al. ..... 463/25
6,471,208 B2 10/2002 Yoseloff et al. ..... 273/143 R
6,471,591 B1 10/2002 Crumby ..... 463/26
6,481,713 B2 11/2002 Perrie et al.
6,485,366 B1 11/2002 Rowe ..... 463/13
6,490,285 B2 12/2002 Lee et al.
6,494,454 B2 12/2002 Adams ..... 273/292
6,494,785 B1 12/2002 Gerrard et al. ..... 463/20
6,497,408 B1 12/2002 Walker et al. ..... 273/138.1
6,502,116 B1 12/2002 Kelly et al. ..... 708/250
6,503,147 B1 1/2003 Stockdale et al. ..... 463/29
6,505,772 B1 1/2003 Mollett et al. ..... 235/379
6,506,118 B1 1/2003 Baerlocher et al. ..... 463/25
6,508,709 B1 1/2003 Karmarkar ..... 463/42
6,508,710 B1 1/2003 Paravia et al. ..... 463/42
6,511,375 B1 1/2003 Kaminkow ..... 463/20
6,514,141 B1 2/2003 Kaminkow et al. ..... 463/25
6,516,350 B1 2/2003 Lumelsky et al.
6,517,435 B2 2/2003 Soltys et al. ..... 463/25
6,517,436 B2 2/2003 Soltys et al. ..... 463/29
6,517,437 B1 2/2003 Wells et al. ..... 463/30
6,520,856 B1 2/2003 Walker et al. ..... 463/21
6,520,857 B2 2/2003 Soltys et al. ..... 463/29
6,527,271 B2 3/2003 Soltys et al. ..... 273/148 R
6,527,638 B1 3/2003 Walker et al. ..... 463/25
6,530,836 B2 3/2003 Soltys et al. ..... 463/29
6,530,837 B2 3/2003 Soltys et al. ..... 463/29
6,533,276 B2 3/2003 Soltys et al. ..... 273/148 R
6,533,662 B2 3/2003 Soltys et al. ..... 463/25
6,533,664 B1 3/2003 Crumby ..... 463/42
6,543,770 B1 4/2003 Kaji et al. ..... 273/148 R
6,561,897 B1 5/2003 Bourbour et al. ..... 463/13
6,561,900 B1 5/2003 Baerlocher et al. ..... 463/20
6,565,433 B1 5/2003 Baerlocher et al. ..... 463/20
6,565,436 B1 5/2003 Baerlocher ..... 463/26
6,568,678 B2 5/2003 Breeding et al. ..... 273/149 R
6,569,015 B1 5/2003 Baerlocher et al. ..... 463/16
6,572,472 B1 6/2003 Glavich ..... 463/16
6,572,473 B1 6/2003 Baerlocher ..... 463/20
6,575,829 B2 6/2003 Coleman et al. ..... 463/20
6,579,179 B2 6/2003 Poole et al. ..... 463/25
6,579,180 B2 6/2003 Soltys et al. ..... 463/25
6,579,181 B2 6/2003 Soltys et al. ..... 463/25
6,581,747 B1 6/2003 Charlier et al. ..... 194/214
6,582,306 B1 6/2003 Kaminkow ..... 463/20
6,582,307 B2 6/2003 Webb ..... 463/22
6,585,588 B2 7/2003 Hartl ..... 463/16
6,585,591 B1 7/2003 Baerlocher et al. ..... 463/25
6,585,592 B1 7/2003 Crumby ..... 463/26
6,588,750 B1 7/2003 Grauzer et al. ..... 273/149 R
6,588,751 B1 7/2003 Grauzer et al. ..... 273/149 R
6,592,458 B1 7/2003 Ho ..... 463/17
6,595,854 B2 7/2003 Hughs-Baird et al. ..... 463/20
6,595,857 B2 7/2003 Soltys et al. ..... 463/29
6,599,185 B1 7/2003 Kaminkow et al. ..... 463/16
6,599,192 B1 7/2003 Baerlocher et al. ..... 463/25
6,599,193 B2 7/2003 Baerlocher et al. ..... 463/27
6,602,135 B1 8/2003 Gerrard ..... 463/16
6,602,136 B1 8/2003 Baerlocher et al. ..... 463/16
6,602,137 B2 8/2003 Kaminkow et al. ..... 463/16
6,605,000 B2 8/2003 Adams ..... 463/20
6,607,438 B2 8/2003 Baerlocher et al. ..... 463/16
6,607,441 B1 8/2003 Acres ..... 463/25
6,609,974 B2 8/2003 Mead et al. ..... 463/25
6,609,978 B1 8/2003 Paulsen ..... 463/42
6,620,046 B2 9/2003 Rowe ..... 463/25
6,620,047 B1 9/2003 Alcorn et al. ..... 463/37
6,623,357 B2 9/2003 Chowdhury ..... 463/25
6,629,184 B1 9/2003 Berg et al. ..... 710/306
6,629,591 B1 10/2003 Griswold et al. ..... 194/205
6,632,139 B1 10/2003 Baerlocher ..... 463/16
6,632,141 B2 10/2003 Webb et al. ..... 463/25
6,634,943 B1 10/2003 Baerlocher ..... 463/25
6,634,945 B2 10/2003 Glavich et al. ..... 463/25
6,638,161 B2 10/2003 Soltys et al. ..... 463/12
6,638,164 B2 10/2003 Randall et al. ..... 463/20
6,638,170 B1 10/2003 Crumby ..... 463/42
6,645,073 B2 11/2003 Lemay et al. ..... 463/20
6,645,077 B2 11/2003 Rowe ..... 463/42
6,648,753 B1 11/2003 Tracy et al. ..... 463/16
6,648,754 B2 11/2003 Baerlocher et al. ..... 463/17
6,651,981 B2 11/2003 Grauzer et al. ..... 273/149 R
6,651,982 B2 11/2003 Grauzer et al. ..... 273/149 R
6,651,985 B2 11/2003 Sines et al. ..... 273/309
6,652,378 B2 11/2003 Cannon et al. ..... 463/20
6,655,684 B2 12/2003 Grauzer et al. ..... 273/149 R
6,656,048 B2 12/2003 Olsen ..... 463/25
6,659,460 B2 12/2003 Blaha et al. ..... 273/149 R
6,659,461 B2 12/2003 Yoseloff et al. ..... 273/274
6,659,864 B2 12/2003 McGahn et al. ..... 463/16
6,663,488 B1 12/2003 Adams ..... 463/17
6,663,489 B2 12/2003 Baerlocher ..... 463/20
6,663,490 B2 12/2003 Soltys et al. ..... 463/25
6,669,559 B1 12/2003 Baerlocher et al. ..... 463/16
6,672,960 B1 1/2004 B-Jensen ..... 463/20
6,675,152 B1 1/2004 Prasad et al. ..... 705/64
6,676,127 B2 1/2004 Johnson et al. ..... 273/149 R
6,676,510 B1 1/2004 Bittman et al. ..... 463/20
6,676,516 B2 1/2004 Baerlocher et al. ..... 463/25
6,676,522 B2 1/2004 Rowe et al. ..... 463/42
6,682,421 B1 1/2004 Rowe et al. ..... 463/25
6,682,423 B2 1/2004 Brosnan et al. ..... 463/29
6,685,189 B2 2/2004 Cherven
6,685,564 B2 2/2004 Oliver ..... 463/25
6,685,567 B2 2/2004 Cockerille et al. ..... 463/43
6,685,568 B2 2/2004 Soltys et al. ..... 463/47
6,688,975 B2 2/2004 Baerlocher et al. ..... 463/16
6,688,977 B1 2/2004 Baerlocher et al. ..... 463/25
6,688,979 B2 2/2004 Soltys et al. ..... 463/25
6,692,354 B2 2/2004 Tracy et al. ..... 463/16
6,692,355 B2 2/2004 Baerlocher et al. ..... 463/16
6,695,696 B1 2/2004 Kaminkow ..... 463/16
6,698,756 B1 3/2004 Baker et al. ..... 273/149 R
6,698,759 B2 3/2004 Webb et al. ..... 273/292
6,699,128 B1 3/2004 Beadell et al. ..... 463/46
6,702,291 B2 3/2004 Grebler et al. ..... 273/292
6,702,667 B2 3/2004 Mattice et al. ..... 463/16
6,702,675 B2 3/2004 Poole et al. ..... 463/31
6,709,332 B2 3/2004 Adams ..... 463/20
6,712,693 B1 3/2004 Hettinger ..... 463/20
6,712,694 B1 3/2004 Nordman ..... 463/20
6,712,695 B2 3/2004 Mothwurf et al. ..... 463/25
6,712,696 B2 3/2004 Soltys et al. ..... 463/25
6,718,361 B1 4/2004 Basani et al. ..... 709/201
6,719,288 B2 4/2004 Hessing et al. ..... 273/149 R
6,719,632 B2 4/2004 Palmer et al. ..... 463/25
6,722,974 B2 4/2004 Sines et al. ..... 463/12
6,722,981 B2 4/2004 Kaminkow et al. ..... 463/25
6,722,982 B2 4/2004 Kaminkow et al. ..... 463/25
6,722,983 B2 4/2004 Kaminkow et al. ..... 463/26
6,722,985 B2 4/2004 Criss-Puszkiewicz et al.
6,726,205 B1 4/2004 Purton ..... 273/148 R
6,726,563 B1 4/2004 Baerlocher et al. ..... 463/25
6,726,565 B2 4/2004 Hughs-Baird ..... 463/25
6,729,961 B1 5/2004 Millerschone ..... 463/30
6,733,386 B2 5/2004 Cuddy et al. ..... 463/17

(56) References Cited

U.S. PATENT DOCUMENTS

| | | | | |
|---|---|---|---|---|
| 6,733,389 | B2 | 5/2004 | Webb et al. | 463/20 |
| 6,739,973 | B1 | 5/2004 | Lucchesi et al. | 463/35 |
| 6,743,102 | B1 | 6/2004 | Fiechter et al. | 463/42 |
| 6,746,330 | B2 | 6/2004 | Cannon | 463/25 |
| 6,749,504 | B2 | 6/2004 | Hughs-Baird | 463/25 |
| 6,752,312 | B1 | 6/2004 | Chamberlain et al. | 235/375 |
| 6,755,741 | B1 | 6/2004 | Rafaeli | 463/25 |
| 6,758,747 | B2 | 7/2004 | Baerlocher | 463/16 |
| 6,758,750 | B2 | 7/2004 | Baerlocher et al. | 463/25 |
| 6,758,751 | B2 | 7/2004 | Soltys et al. | 463/29 |
| 6,769,983 | B2 | 8/2004 | Slomiany | 463/16 |
| 6,789,801 | B2 | 9/2004 | Snow | 273/292 |
| 6,800,029 | B2 | 10/2004 | Rowe et al. | 463/25 |
| 6,808,173 | B2 | 10/2004 | Snow | 273/292 |
| 6,811,486 | B1 | 11/2004 | Luciano, Jr. | 463/24 |
| 6,811,488 | B2 | 11/2004 | Paravia et al. | 463/42 |
| 6,817,948 | B2 | 11/2004 | Pascal et al. | 463/42 |
| 6,823,419 | B2 | 11/2004 | Berg et al. | 710/306 |
| 6,837,789 | B2 | 1/2005 | Garahi et al. | 463/29 |
| 6,848,994 | B1 | 2/2005 | Knust et al. | 463/25 |
| 6,854,085 | B1 | 2/2005 | Morse | |
| 6,857,961 | B2 | 2/2005 | Soltys et al. | 463/47 |
| 6,866,581 | B2 | 3/2005 | Martinek et al. | 463/16 |
| 6,874,786 | B2 | 4/2005 | Bruno et al. | 273/306 |
| 6,884,170 | B2 | 4/2005 | Rowe | |
| 6,884,173 | B2 | 4/2005 | Gauselmann | 463/42 |
| 6,884,174 | B2 | 4/2005 | Lundy et al. | 463/42 |
| 6,889,979 | B2 | 5/2005 | Blaha et al. | 273/149 R |
| 6,896,618 | B2 | 5/2005 | Benoy et al. | 463/25 |
| 6,899,627 | B2 | 5/2005 | Lam et al. | 463/40 |
| 6,901,440 | B1 | 5/2005 | Bimm et al. | |
| 6,908,387 | B2 | 6/2005 | Hedrick et al. | 463/31 |
| 6,912,812 | B2 | 7/2005 | Inage | 49/409 |
| 6,923,446 | B2 | 8/2005 | Snow | 273/292 |
| 6,938,900 | B2 | 9/2005 | Snow | 273/292 |
| 6,955,599 | B2 | 10/2005 | Bourbour et al. | 463/13 |
| 6,960,134 | B2 | 11/2005 | Hartl et al. | 463/20 |
| 6,964,612 | B2 | 11/2005 | Soltys et al. | 463/47 |
| 6,971,956 | B2 | 12/2005 | Rowe et al. | 463/25 |
| 6,972,682 | B2 | 12/2005 | Lareau et al. | 340/568.1 |
| 6,986,514 | B2 | 1/2006 | Snow | 273/292 |
| 6,991,540 | B2 | 1/2006 | Marlow | 463/16 |
| 6,991,544 | B2 | 1/2006 | Soltys et al. | 463/42 |
| 6,993,587 | B1 | 1/2006 | Basani et al. | 709/229 |
| 6,997,803 | B2 | 2/2006 | LeMay et al. | 463/20 |
| 7,000,921 | B2 | 2/2006 | Schultz | 273/292 |
| 7,013,469 | B2 | 3/2006 | Smith et al. | |
| 7,025,674 | B2 | 4/2006 | Adams et al. | |
| 7,027,996 | B2 | 4/2006 | Levinson | |
| 7,036,818 | B2 | 5/2006 | Grauzer et al. | 273/149 R |
| 7,037,195 | B2 | 5/2006 | Schneider et al. | 463/25 |
| 7,050,056 | B2 | 5/2006 | Meyringer | 345/440 |
| 7,051,101 | B1 | 5/2006 | Dubrovsky et al. | |
| 7,055,823 | B2 | 6/2006 | Denkewicz, Jr. | |
| 7,073,791 | B2 | 7/2006 | Grauzer et al. | 273/149 R |
| 7,077,332 | B2 | 7/2006 | Verschuur et al. | 235/492 |
| 7,086,947 | B2 | 8/2006 | Walker et al. | 463/25 |
| 7,099,035 | B2 | 8/2006 | Brooks et al. | 358/1.15 |
| 7,100,184 | B1 | 8/2006 | Kahn | |
| 7,120,879 | B2 | 10/2006 | Gutberlet et al. | |
| 7,137,627 | B2 | 11/2006 | Grauzer et al. | 273/149 R |
| 7,147,558 | B2 | 12/2006 | Giobbi | 463/25 |
| RE39,644 | E | 5/2007 | Alcorn et al. | 380/251 |
| 7,255,344 | B2 | 8/2007 | Grauzer et al. | 273/149 R |
| 7,260,834 | B1 | 8/2007 | Carlson | |
| 7,275,988 | B2 | 10/2007 | Aida et al. | 463/20 |
| 7,291,068 | B2 | 11/2007 | Bryant et al. | 463/25 |
| 7,297,062 | B2 | 11/2007 | Gatto et al. | |
| 7,300,352 | B2 | 11/2007 | Rowe | |
| 7,303,475 | B2 | 12/2007 | Britt et al. | 463/42 |
| 7,311,598 | B2 | 12/2007 | Kaminkow et al. | |
| 7,322,576 | B2 | 1/2008 | Grauzer et al. | 273/149 R |
| 7,329,185 | B2 | 2/2008 | Conover et al. | 463/25 |
| 7,330,822 | B1 | 2/2008 | Robson et al. | 705/9 |
| 7,331,520 | B2 | 2/2008 | Silva et al. | 235/381 |
| 7,331,859 | B2 | 2/2008 | Hornik et al. | 463/16 |
| 7,337,330 | B2 | 2/2008 | Gatto et al. | |
| 7,338,044 | B2 | 3/2008 | Grauzer et al. | 273/149 R |
| 7,341,254 | B2 | 3/2008 | Loewenstein et al. | 273/292 |
| 7,346,682 | B2 | 3/2008 | Basani et al. | 709/224 |
| 7,349,920 | B1 | 3/2008 | Feinberg et al. | 707/102 |
| 7,351,145 | B1 | 4/2008 | Ornstein et al. | 463/25 |
| 7,353,183 | B1 | 4/2008 | Musso | |
| 7,356,770 | B1 | 4/2008 | Jackson | 715/736 |
| 7,363,342 | B1 | 4/2008 | Wang et al. | 709/204 |
| 7,364,510 | B2 | 4/2008 | Walker et al. | 463/42 |
| 7,370,282 | B2 | 5/2008 | Cary | 715/772 |
| 7,398,327 | B2 | 7/2008 | Lee | 709/250 |
| 7,399,226 | B2 | 7/2008 | Mishra | 463/18 |
| 7,404,763 | B2 | 7/2008 | Malone et al. | 463/13 |
| 7,410,422 | B2 | 8/2008 | Fine | 463/42 |
| 7,427,233 | B2 | 9/2008 | Walker et al. | 463/16 |
| 7,427,234 | B2 | 9/2008 | Soltys et al. | 463/16 |
| 7,427,236 | B2 | 9/2008 | Kaminkow et al. | 463/26 |
| 7,458,890 | B2 | 12/2008 | Loose et al. | 463/16 |
| 7,460,863 | B2 | 12/2008 | Steelberg et al. | 455/419 |
| 7,465,231 | B2 | 12/2008 | Lewin et al. | 463/37 |
| 7,473,178 | B2 | 1/2009 | Boyd et al. | |
| 7,481,430 | B1 | 1/2009 | Jackson et al. | |
| 7,483,394 | B2 | 1/2009 | Chang et al. | 370/254 |
| 7,484,207 | B2 | 1/2009 | Sato | |
| 7,515,718 | B2 | 4/2009 | Nguyen et al. | 380/278 |
| 7,534,169 | B2 | 5/2009 | Amaitis et al. | 463/39 |
| 7,540,806 | B2 | 6/2009 | Tastad | 463/46 |
| 7,549,576 | B2 | 6/2009 | Alderucci et al. | 235/380 |
| 7,566,274 | B2 | 7/2009 | Johnson et al. | |
| 7,575,234 | B2 | 8/2009 | Soltys et al. | 273/149 R |
| 7,578,739 | B2 | 8/2009 | Gauselmann | 463/27 |
| 7,585,217 | B2 | 9/2009 | Lutnick et al. | 463/16 |
| 7,585,220 | B2 | 9/2009 | Loose et al. | 463/20 |
| 7,594,030 | B2 | 9/2009 | Teodosiu et al. | |
| 7,607,976 | B2 | 10/2009 | Baerlocher et al. | |
| 7,607,977 | B2 | 10/2009 | Baerlocher et al. | |
| 7,610,549 | B2 | 10/2009 | Vignet | |
| 7,611,407 | B1 | 11/2009 | Itkis et al. | 463/29 |
| 7,611,409 | B2 | 11/2009 | Muir et al. | 463/29 |
| 7,617,151 | B2 | 11/2009 | Rowe | 705/39 |
| 7,618,317 | B2 | 11/2009 | Jackson | 463/24 |
| 7,621,809 | B2 | 11/2009 | Baerlocher et al. | |
| 7,629,886 | B2 | 12/2009 | Steeves | 340/572.1 |
| 7,634,550 | B2 | 12/2009 | Wolber et al. | 709/220 |
| 7,648,414 | B2 | 1/2010 | McNutt et al. | 463/25 |
| 7,661,676 | B2 | 2/2010 | Smith et al. | 273/149 R |
| 7,666,081 | B2 | 2/2010 | Baerlocher et al. | |
| 7,674,179 | B2 | 3/2010 | Baerlocher et al. | |
| 7,682,249 | B2 | 3/2010 | Winans et al. | 463/31 |
| 7,684,874 | B2 | 3/2010 | Schlottmann et al. | 700/9 |
| 7,684,882 | B2 | 3/2010 | Baerlocher et al. | |
| 7,685,516 | B2 | 3/2010 | Fischer | |
| 7,686,688 | B2 | 3/2010 | Friedman et al. | 463/25 |
| 7,688,322 | B2 | 3/2010 | Kapler et al. | |
| 7,689,302 | B2 | 3/2010 | Schlottmann et al. | |
| 7,699,697 | B2 | 4/2010 | Darrah et al. | |
| 7,699,703 | B2 | 4/2010 | Muir et al. | 463/29 |
| 7,702,719 | B1 | 4/2010 | Betz et al. | |
| 7,706,895 | B2 | 4/2010 | Callaghan | |
| 7,712,050 | B2 | 5/2010 | Gutberlet et al. | |
| 7,722,453 | B2 | 5/2010 | Lark et al. | 463/16 |
| 7,730,198 | B2 | 6/2010 | Ruppert et al. | 709/230 |
| 7,736,223 | B2 | 6/2010 | Pace | 463/19 |
| 7,744,462 | B2 | 6/2010 | Grav et al. | 463/27 |
| 7,747,741 | B2 | 6/2010 | Basani et al. | 709/224 |
| 7,753,790 | B2 | 7/2010 | Nguyen et al. | 463/42 |
| 7,769,877 | B2 | 8/2010 | McBride et al. | 709/230 |
| 7,775,868 | B2 | 8/2010 | Toyoda | 463/12 |
| 7,778,635 | B2 | 8/2010 | Crookham et al. | 455/426.1 |
| 7,780,525 | B2 | 8/2010 | Walker et al. | 463/29 |
| 7,780,526 | B2 | 8/2010 | Nguyen et al. | 463/29 |
| 7,780,529 | B2 | 8/2010 | Rowe et al. | |
| 7,785,204 | B2 | 8/2010 | Wells et al. | |
| 7,787,972 | B2 | 8/2010 | Schlottmann et al. | |
| 7,788,503 | B2 | 8/2010 | Gatto et al. | |
| 7,805,719 | B2 | 9/2010 | O'Neill | |
| 7,819,745 | B2 | 10/2010 | Cuddy et al. | |

(56) References Cited

U.S. PATENT DOCUMENTS 7,841,946 B2 11/2010 Walker et al. ..... 463/42
7,844,944 B2 11/2010 Gutberlet et al.
7,846,020 B2 12/2010 Walker et al. ..... 463/29
7,850,528 B2 12/2010 Wells ..... 463/42
7,854,654 B2 12/2010 Baerlocher et al.
7,857,702 B2 12/2010 Hilbert
7,862,425 B2 1/2011 Cavagna ..... 463/25
7,874,920 B2 1/2011 Hornik et al.
7,874,921 B2 1/2011 Baszucki et al. ..... 463/43
7,886,288 B2 2/2011 Breckner et al.
7,892,093 B2 2/2011 Kniesteadt et al.
7,898,679 B2 3/2011 Brack et al. ..... 358/1.15
7,901,294 B2 3/2011 Walker et al. ..... 463/42
7,908,486 B2 3/2011 Gatto et al.
7,918,735 B2 4/2011 Inamura
7,921,026 B2 4/2011 O'Cull et al.
7,921,405 B2 4/2011 Gupta et al.
7,937,464 B2 5/2011 Ruppert et al. ..... 709/224
7,963,847 B2 6/2011 Baerlocher
7,976,389 B2 7/2011 Cannon et al.
7,993,199 B2 8/2011 Iddings et al.
8,025,574 B2 9/2011 Hilbert
8,033,913 B2 10/2011 Cockerille et al.
8,051,180 B2 11/2011 Mazzaferri et al.
8,057,297 B2 11/2011 Silvestro et al.
8,062,121 B2 11/2011 Crivelli
8,070,583 B2 12/2011 Baerlocher et al.
8,070,597 B2 12/2011 Cuddy
8,073,657 B2 12/2011 Moore, III et al.
8,075,396 B2 12/2011 Roemer
8,117,461 B2 2/2012 Bigelow, Jr. et al.
8,177,634 B2 5/2012 Herrmann et al.
8,182,346 B2 5/2012 Herrmann et al.
8,187,101 B2 5/2012 Herrmann et al.
8,192,289 B2 6/2012 Herrmann et al.
8,197,344 B2 6/2012 Rathsack et al.
8,201,229 B2 6/2012 Ruppert et al.
8,246,466 B2 8/2012 Herrmann et al.
8,267,773 B2 9/2012 Jaffe et al.
8,267,797 B2 9/2012 Thomas et al.
8,277,324 B2 10/2012 Herrmann et al.
8,280,777 B2 10/2012 Mengerink et al.
8,285,740 B2 10/2012 Graham et al.
8,308,554 B2 11/2012 Rowe et al.
8,360,870 B2 1/2013 Herrmann et al.
8,366,550 B2 2/2013 Herrmann et al.
8,512,150 B2 8/2013 Herrmann et al.
2001/0019966 A1 9/2001 Idaka ..... 463/40
2002/0004824 A1 1/2002 Cuan et al.
2002/0024179 A1 2/2002 Chida ..... 273/307
2002/0027322 A1 3/2002 Breeding et al. ..... 273/292
2002/0063389 A1 5/2002 Breeding et al. ..... 273/292
2002/0084587 A1 7/2002 Bennett et al. ..... 273/309
2002/0086725 A1 7/2002 Fasbender et al.
2002/0107067 A1 8/2002 McGlone et al. ..... 463/20
2002/0111210 A1 8/2002 Luciano, Jr. et al. ..... 463/29
2002/0111213 A1 8/2002 McEntee et al. ..... 463/42
2002/0113371 A1 8/2002 Snow ..... 273/292
2002/0115487 A1 8/2002 Wells ..... 463/42
2002/0116615 A1 8/2002 Nguyen et al. ..... 713/168
2002/0119824 A1 8/2002 Allen
2002/0138594 A1 9/2002 Rowe ..... 709/219
2002/0142844 A1 10/2002 Kerr
2002/0144115 A1 10/2002 Lemay et al.
2002/0147042 A1 10/2002 Vuong et al. ..... 463/40
2002/0152120 A1 10/2002 Howington
2002/0155869 A1 10/2002 Soltys et al. ..... 463/11
2002/0163125 A1 11/2002 Grauzer et al. ..... 273/149 R
2002/0187821 A1 12/2002 Soltys et al. ..... 463/11
2002/0187825 A1 12/2002 Tracy et al. ..... 463/17
2002/0187830 A1 12/2002 Stockdale et al. ..... 463/29
2002/0195773 A1 12/2002 Dunn ..... 273/274
2002/0198044 A1 12/2002 Walker et al.
2003/0003988 A1* 1/2003 Walker et al. ..... 463/21
2003/0004871 A1 1/2003 Rowe ..... 705/39
2003/0027625 A1 2/2003 Rowe ..... 463/20
2003/0027638 A1 2/2003 Schneider et al. ..... 463/42
2003/0032471 A1* 2/2003 Darder ..... 463/16
2003/0032474 A1 2/2003 Kaminkow ..... 463/25
2003/0036425 A1 2/2003 Kaminkow et al. ..... 463/25
2003/0042679 A1 3/2003 Snow ..... 273/292
2003/0054881 A1 3/2003 Hedrick et al. ..... 463/29
2003/0064798 A1 4/2003 Grauzer et al. ..... 463/29
2003/0069074 A1 4/2003 Jackson ..... 463/43
2003/0075869 A1 4/2003 Breeding et al. ..... 273/292
2003/0078103 A1 4/2003 LeMay et al. ..... 463/43
2003/0078789 A1 4/2003 Oren ..... 705/1
2003/0083126 A1 5/2003 Paulsen ..... 463/25
2003/0090064 A1 5/2003 Hoyt et al. ..... 273/292
2003/0130024 A1 7/2003 Darby ..... 463/13
2003/0134675 A1 7/2003 Oberberger
2003/0144965 A1 7/2003 Prasad et al. ..... 705/65
2003/0171145 A1 9/2003 Rowe ..... 463/25
2003/0176209 A1 9/2003 Soltys et al. ..... 463/13
2003/0182414 A1 9/2003 O'Neill
2003/0185229 A1 10/2003 Shachar et al.
2003/0186733 A1 10/2003 Wolf et al. ..... 463/16
2003/0186739 A1 10/2003 Paulsen et al. ..... 463/25
2003/0195037 A1 10/2003 Vuong et al. ..... 463/29
2003/0206548 A1 11/2003 Bannai et al. ..... 370/389
2003/0216165 A1 11/2003 Singer et al. ..... 463/20
2003/0224858 A1 12/2003 Yoseloff et al. ..... 463/43
2003/0228912 A1 12/2003 Wells et al. ..... 463/43
2003/0232640 A1 12/2003 Walker et al. ..... 463/16
2003/0232647 A1 12/2003 Moser ..... 463/29
2003/0232651 A1 12/2003 Huard et al. ..... 463/42
2004/0002385 A1 1/2004 Nguyen ..... 463/42
2004/0002386 A1 1/2004 Wolfe et al.
2004/0002388 A1 1/2004 Larsen et al. ..... 463/43
2004/0029635 A1 2/2004 Giobbi ..... 463/30
2004/0033095 A1 2/2004 Saffari et al. ..... 400/120.01
2004/0041346 A1 3/2004 Snow ..... 273/292
2004/0043815 A1 3/2004 Kaminkow ..... 463/25
2004/0043820 A1 3/2004 Schlottmann ..... 463/43
2004/0048671 A1 3/2004 Rowe ..... 463/42
2004/0053673 A1 3/2004 Mishra ..... 463/20
2004/0064817 A1 4/2004 Shibayama et al.
2004/0067789 A1 4/2004 Grauzer et al. ..... 463/11
2004/0068654 A1 4/2004 Cockerille et al. ..... 713/168
2004/0082385 A1 4/2004 Silva et al. ..... 463/40
2004/0090003 A1 5/2004 Snow ..... 273/274
2004/0102244 A1 5/2004 Kryuchkov et al. ..... 463/32
2004/0106452 A1 6/2004 Nguyen et al. ..... 463/42
2004/0108255 A1 6/2004 Johnson ..... 209/547
2004/0108654 A1 6/2004 Grauzer et al. ..... 273/148 R
2004/0110119 A1 6/2004 Riconda et al. ..... 434/350
2004/0127291 A1 7/2004 George et al. ..... 463/42
2004/0132529 A1 7/2004 Mkrtchyan et al. ..... 463/29
2004/0132532 A1 7/2004 Brosnan et al. ..... 463/42
2004/0133485 A1 7/2004 Schoomaker et al. ..... 705/30
2004/0142743 A1 7/2004 Oliver ..... 463/25
2004/0142744 A1 7/2004 Atkinson et al. ..... 463/29
2004/0147314 A1 7/2004 LeMay et al. ..... 463/30
2004/0150702 A1 8/2004 Tsuyoshi et al. ..... 347/100
2004/0166940 A1 8/2004 Rothschild ..... 463/42
2004/0169332 A1 9/2004 Grauzer et al. ..... 273/149 R
2004/0185936 A1 9/2004 Block et al. ..... 463/42
2004/0224777 A1 11/2004 Smith et al. ..... 463/47
2004/0229684 A1 11/2004 Blackburn et al.
2004/0254012 A1 12/2004 D'Amico et al. ..... 463/26
2004/0254993 A1 12/2004 Mamas
2004/0259618 A1* 12/2004 Soltys et al. ..... 463/11
2004/0259630 A1 12/2004 Huard et al.
2005/0012270 A1 1/2005 Schubert et al. ..... 273/149 R
2005/0023752 A1 2/2005 Grauzer et al. ..... 273/149 R
2005/0040594 A1 2/2005 Krenn et al. ..... 273/149 R
2005/0043094 A1 2/2005 Nguyen et al. ..... 463/42
2005/0054438 A1 3/2005 Rothschild et al. ..... 463/29
2005/0054445 A1 3/2005 Gatto et al. ..... 463/42
2005/0059479 A1 3/2005 Soltys et al. ..... 463/29
2005/0062227 A1 3/2005 Grauzer et al. ..... 273/149 R
2005/0070358 A1 3/2005 Angell et al. ..... 463/39
2005/0073102 A1 4/2005 Yoseloff et al. ..... 273/292
2005/0080898 A1 4/2005 Block

(56) References Cited

U.S. PATENT DOCUMENTS

2005/0093230 A1 5/2005 Grauzer et al. ..... 273/149 R
2005/0098951 A1 5/2005 Groves ..... 273/292
2005/0101367 A1 5/2005 Soltys et al. ..... 463/12
2005/0119052 A1 6/2005 Russell et al. ..... 463/42
2005/0121852 A1 6/2005 Soltys et al. ..... 273/149 P
2005/0124411 A1 6/2005 Schneider et al. ..... 463/29
2005/0137005 A1 6/2005 Soltys et al. ..... 463/13
2005/0153778 A1 7/2005 Nelson et al. ..... 463/42
2005/0164761 A1 7/2005 Tain ..... 463/13
2005/0171808 A1 8/2005 Saenz et al.
2005/0181856 A1 8/2005 Cannon et al. ..... 463/16
2005/0215311 A1 9/2005 Hornik et al. ..... 463/20
2005/0222891 A1 10/2005 Chan et al. ..... 705/9
2005/0239542 A1 10/2005 Olsen ..... 463/27
2005/0266919 A1 12/2005 Rowe et al. ..... 463/25
2005/0282614 A1 12/2005 Gauselmann ..... 463/20
2005/0282626 A1 12/2005 Manfredi et al. ..... 463/25
2006/0001217 A1 1/2006 Soltys et al. ..... 273/292
2006/0004618 A1 1/2006 Brixius ..... 705/8
2006/0009282 A1 1/2006 George et al. ..... 463/29
2006/0015716 A1 1/2006 Thornton et al. ..... 713/155
2006/0019745 A1 1/2006 Benbrahim ..... 463/29
2006/0026499 A1 2/2006 Weddle ..... 715/503
2006/0031763 A1 2/2006 Yeung
2006/0035707 A1 2/2006 Nguyen et al. ..... 463/29
2006/0046849 A1 3/2006 Kovacs ..... 463/39
2006/0058100 A1 3/2006 Pacey et al. ..... 463/31
2006/0063581 A1 3/2006 Harris et al.
2006/0079317 A1 4/2006 Flemming et al. ..... 463/25
2006/0116208 A1 6/2006 Chen et al. ..... 463/43
2006/0121970 A1 6/2006 Khal ..... 463/16
2006/0125181 A1* 6/2006 Malone et al. ..... 273/292
2006/0181026 A1 8/2006 Wong
2006/0183541 A1 8/2006 Okada et al. ..... 463/29
2006/0195847 A1 8/2006 Amano et al. ..... 718/103
2006/0205484 A1 9/2006 Nicastro
2006/0205508 A1 9/2006 Green ..... 463/40
2006/0205519 A1 9/2006 Soltys
2006/0217202 A1 9/2006 Burke et al.
2006/0247013 A1 11/2006 Walker et al. ..... 463/20
2006/0247057 A1 11/2006 Green et al. ..... 463/42
2006/0248161 A1 11/2006 O'Brien et al. ..... 709/217
2006/0252530 A1 11/2006 Oberberger et al.
2006/0253702 A1 11/2006 Lowell et al.
2006/0259604 A1 11/2006 Kotchavi et al.
2006/0277487 A1 12/2006 Poulsen et al. ..... 715/772
2006/0281529 A1 12/2006 Seelig et al. ..... 463/20
2006/0281556 A1 12/2006 Solomon et al. ..... 463/43
2006/0287098 A1 12/2006 Morrow et al.
2007/0004500 A1 1/2007 Soltys et al. ..... 463/22
2007/0006329 A1 1/2007 Morrow et al. ..... 726/34
2007/0015583 A1 1/2007 Tran ..... 463/40
2007/0026935 A1 2/2007 Wolf et al.
2007/0026942 A1 2/2007 Kinsley et al.
2007/0032288 A1 2/2007 Nelson et al.
2007/0033247 A1 2/2007 Martin ..... 709/201
2007/0054740 A1 3/2007 Salls et al. ..... 463/42
2007/0057453 A1 3/2007 Soltys et al. ..... 273/149 P
2007/0057454 A1 3/2007 Fleckenstein ..... 273/149 R
2007/0057462 A1 3/2007 Fleckenstein ..... 273/274
2007/0057466 A1 3/2007 Soltys et al. ..... 273/292
2007/0057469 A1 3/2007 Grauzer et al. ..... 273/309
2007/0060259 A1 3/2007 Pececnik ..... 463/16
2007/0060260 A1 3/2007 Fleckenstein ..... 463/16
2007/0060307 A1 3/2007 Mathis et al. ..... 463/25
2007/0060320 A1 3/2007 Kelly et al.
2007/0060365 A1 3/2007 Tien et al. ..... 463/42
2007/0077990 A1 4/2007 Cuddy et al. ..... 463/25
2007/0077995 A1 4/2007 Oak et al. ..... 463/42
2007/0082737 A1 4/2007 Morrow et al. ..... 463/42
2007/0093298 A1 4/2007 Brunet ..... 463/42
2007/0105628 A1 5/2007 Arbogast et al. ..... 463/42
2007/0111775 A1 5/2007 Yoseloff ..... 463/16
2007/0111791 A1 5/2007 Arbogast et al. ..... 463/40
2007/0111794 A1 5/2007 Hogan et al. ..... 463/42
2007/0117608 A1 5/2007 Roper et al. ..... 463/16
2007/0118844 A1 5/2007 Huang et al.
2007/0124483 A1 5/2007 Marples et al. ..... 709/228
2007/0129145 A1 6/2007 Blackburn et al. ..... 463/42
2007/0150329 A1 6/2007 Brook et al. ..... 705/8
2007/0155490 A1 7/2007 Phillips et al.
2007/0167235 A1 7/2007 Naicker ..... 463/42
2007/0168251 A1 7/2007 Hilbert et al. ..... 705/14
2007/0191102 A1 8/2007 Coliz et al. ..... 463/42
2007/0192748 A1 8/2007 Martin et al. ..... 715/856
2007/0198418 A1 8/2007 MacDonald et al. ..... 705/52
2007/0207850 A1 9/2007 Darrah et al. ..... 463/20
2007/0208816 A1 9/2007 Baldwin et al. ..... 709/206
2007/0214030 A1 9/2007 Shear et al.
2007/0218998 A1 9/2007 Arbogast et al. ..... 463/42
2007/0235521 A1 10/2007 Mateen et al. ..... 235/379
2007/0241497 A1 10/2007 Soltys et al. ..... 273/149 R
2007/0241498 A1 10/2007 Soltys ..... 273/149 R
2007/0243925 A1 10/2007 LeMay et al. ..... 463/20
2007/0243927 A1 10/2007 Soltys ..... 463/25
2007/0243935 A1 10/2007 Huizinga ..... 463/42
2007/0259709 A1 11/2007 Kelly et al. ..... 463/20
2007/0259711 A1 11/2007 Thomas ..... 463/22
2007/0298860 A1 12/2007 Graves et al.
2007/0298865 A1 12/2007 Soltys ..... 463/22
2007/0298868 A1 12/2007 Soltys ..... 463/25
2008/0004108 A1 1/2008 Klinkhammer ..... 463/29
2008/0009344 A1 1/2008 Graham et al. ..... 463/25
2008/0026832 A1 1/2008 Stevens et al. ..... 463/26
2008/0026848 A1 1/2008 Byng ..... 463/42
2008/0038035 A1 2/2008 Shuldman et al. ..... 400/76
2008/0045341 A1 2/2008 Englman ..... 463/42
2008/0045342 A1 2/2008 Crowder, Jr. et al.
2008/0058105 A1 3/2008 Combs et al.
2008/0064501 A1 3/2008 Patel ..... 463/40
2008/0065590 A1 3/2008 Castro et al.
2008/0076572 A1 3/2008 Nguyen et al. ..... 463/42
2008/0090651 A1 4/2008 Baerlocher ..... 463/27
2008/0096659 A1 4/2008 Kreloff et al. ..... 463/39
2008/0102919 A1 5/2008 Rowe et al.
2008/0102932 A1 5/2008 Anderson et al.
2008/0108405 A1 5/2008 Brosnan et al.
2008/0108433 A1 5/2008 DiMichele et al. ..... 463/40
2008/0113704 A1 5/2008 Jackson ..... 463/13
2008/0113773 A1 5/2008 Johnson et al. ..... 463/25
2008/0119284 A1 5/2008 Luciano, Jr. et al. ..... 463/42
2008/0127174 A1 5/2008 Johnson
2008/0138773 A1 6/2008 Lathrop
2008/0146337 A1 6/2008 Halonen et al. ..... 463/42
2008/0153599 A1 6/2008 Atashband et al. ..... 463/42
2008/0153600 A1 6/2008 Swarna ..... 463/43
2008/0154916 A1 6/2008 Atashband ..... 707/10
2008/0155665 A1 6/2008 Ruppert et al. ..... 726/5
2008/0162729 A1 7/2008 Ruppert ..... 709/249
2008/0165771 A1 7/2008 Gainey et al.
2008/0171588 A1 7/2008 Atashband ..... 463/20
2008/0171598 A1 7/2008 Deng ..... 463/40
2008/0200255 A1 8/2008 Eisele ..... 463/42
2008/0214277 A1 9/2008 Kishi ..... 463/20
2008/0243697 A1 10/2008 Irving et al. ..... 705/54
2008/0244565 A1 10/2008 Levidow et al.
2008/0261699 A1 10/2008 Topham et al.
2008/0261701 A1 10/2008 Lewin et al. ..... 463/43
2008/0287185 A1 11/2008 Yoseloff et al.
2008/0287197 A1 11/2008 Ruppert et al. ..... 463/42
2008/0293494 A1 11/2008 Adiraju et al. ..... 463/42
2008/0300046 A1 12/2008 Gagner et al.
2008/0311971 A1 12/2008 Dean ..... 463/20
2008/0313282 A1 12/2008 Warila et al.
2008/0318655 A1 12/2008 Davies
2008/0318685 A9 12/2008 Oak et al. ..... 463/42
2009/0005176 A1 1/2009 Morrow et al. ..... 463/43
2009/0005177 A1 1/2009 Kishi et al.
2009/0011833 A1 1/2009 Seelig et al. ..... 463/42
2009/0029775 A1 1/2009 Ruppert et al. ..... 463/42
2009/0031008 A1 1/2009 Elliott et al. ..... 709/220
2009/0054139 A1 2/2009 Anderson
2009/0063309 A1 3/2009 Stephens
2009/0075739 A1 3/2009 Richardson

(56) References Cited

U.S. PATENT DOCUMENTS

| | | | | |
|---|---|---|---|---|
| 2009/0088239 | A1 | 4/2009 | Iddings et al. | |
| 2009/0104977 | A1 | 4/2009 | Zielinski | |
| 2009/0115133 | A1 | 5/2009 | Kelly et al. | 273/274 |
| 2009/0117994 | A1 | 5/2009 | Kelly et al. | 463/25 |
| 2009/0118001 | A1 | 5/2009 | Kelly et al. | 463/29 |
| 2009/0118005 | A1 | 5/2009 | Kelly et al. | 463/31 |
| 2009/0118006 | A1 | 5/2009 | Kelly et al. | 463/31 |
| 2009/0124329 | A1 | 5/2009 | Palmisano | |
| 2009/0124362 | A1 | 5/2009 | Cuddy et al. | |
| 2009/0124392 | A1 | 5/2009 | Ruppert et al. | 463/42 |
| 2009/0124394 | A1 | 5/2009 | Swarna | 463/43 |
| 2009/0125603 | A1 | 5/2009 | Atashband et al. | 709/207 |
| 2009/0131144 | A1 | 5/2009 | Allen | 463/20 |
| 2009/0131163 | A1 | 5/2009 | Arbogast et al. | 463/29 |
| 2009/0132720 | A1 | 5/2009 | Ruppert et al. | 709/231 |
| 2009/0163279 | A1 | 6/2009 | Hermansen et al. | 463/42 |
| 2009/0170594 | A1 | 7/2009 | Delaney et al. | 463/25 |
| 2009/0176556 | A1 | 7/2009 | Gagner et al. | 463/25 |
| 2009/0176578 | A1 | 7/2009 | Herrmann et al. | |
| 2009/0176580 | A1 | 7/2009 | Herrmann et al. | 463/43 |
| 2009/0181776 | A1 | 7/2009 | Deng | 463/42 |
| 2009/0239625 | A1 | 9/2009 | Yoshizawa | |
| 2009/0239667 | A1 | 9/2009 | Rowe et al. | |
| 2009/0253483 | A1 | 10/2009 | Pacey et al. | 463/20 |
| 2009/0270170 | A1 | 10/2009 | Patton | 463/36 |
| 2009/0275374 | A1 | 11/2009 | Nelson et al. | 463/16 |
| 2009/0275393 | A1 | 11/2009 | Kisenwether et al. | 463/25 |
| 2009/0275394 | A1 | 11/2009 | Young et al. | 463/25 |
| 2009/0275395 | A1 | 11/2009 | McAllister et al. | 463/25 |
| 2009/0275398 | A1 | 11/2009 | Nelson | 463/27 |
| 2009/0275399 | A1 | 11/2009 | Kelly et al. | 463/27 |
| 2009/0275400 | A1 | 11/2009 | Rehm et al. | 463/27 |
| 2009/0275401 | A1 | 11/2009 | Allen et al. | 463/29 |
| 2009/0275402 | A1 | 11/2009 | Backover et al. | 463/29 |
| 2009/0275407 | A1 | 11/2009 | Singh et al. | 463/31 |
| 2009/0275410 | A1 | 11/2009 | Kisenwether et al. | 463/42 |
| 2009/0275411 | A1 | 11/2009 | Kisenwether et al. | 463/42 |
| 2009/0276341 | A1 | 11/2009 | McMahan et al. | 705/30 |
| 2009/0298583 | A1 | 12/2009 | Jones | 463/29 |
| 2009/0307069 | A1 | 12/2009 | Meyerhofer | 705/14.12 |
| 2010/0016067 | A1 | 1/2010 | White et al. | 463/25 |
| 2010/0016068 | A1 | 1/2010 | White et al. | 463/25 |
| 2010/0029385 | A1 | 2/2010 | Garvey et al. | 463/35 |
| 2010/0048291 | A1 | 2/2010 | Warkentin | 463/25 |
| 2010/0058320 | A1 | 3/2010 | Milligan et al. | |
| 2010/0062838 | A1 | 3/2010 | Nguyen et al. | |
| 2010/0093440 | A1 | 4/2010 | Burke | |
| 2010/0093441 | A1 | 4/2010 | Rajaraman et al. | 463/42 |
| 2010/0099480 | A1 | 4/2010 | Caputo | |
| 2010/0113125 | A1 | 5/2010 | Bernard et al. | 463/20 |
| 2010/0124990 | A1 | 5/2010 | Crowder | 463/42 |
| 2010/0125851 | A1 | 5/2010 | Singh et al. | 718/104 |
| 2010/0130280 | A1 | 5/2010 | Arezina et al. | 463/20 |
| 2010/0131772 | A1 | 5/2010 | Atashband et al. | 713/189 |
| 2010/0137056 | A1 | 6/2010 | Hoffman et al. | |
| 2010/0151926 | A1 | 6/2010 | Ruppert et al. | 463/1 |
| 2010/0161798 | A1 | 6/2010 | Ruppert et al. | 709/225 |
| 2010/0210353 | A1 | 8/2010 | Gagner et al. | |
| 2010/0234104 | A1 | 9/2010 | Ruppert et al. | 463/30 |
| 2010/0248842 | A1 | 9/2010 | Ruppert | 463/42 |
| 2011/0009184 | A1 | 1/2011 | Byng | 463/20 |
| 2011/0124417 | A1 | 5/2011 | Baynes et al. | 463/43 |
| 2011/0179409 | A1 | 7/2011 | Yoseloff et al. | |
| 2011/0269534 | A1 | 11/2011 | Kelly et al. | |
| 2012/0110649 | A1 | 5/2012 | Murphy | |
| 2012/0203692 | A1 | 8/2012 | Olliphant et al. | |

FOREIGN PATENT DOCUMENTS

| | | | |
|---|---|---|---|
| EP | 1074955 | A2 | 2/2001 |
| EP | 1 291 045 | A2 | 3/2003 |
| EP | 1463008 | A2 | 9/2004 |
| GB | 2 370 791 | A | 7/2002 |
| GB | 2 380 143 | A | 4/2003 |
| JP | 8255059 | | 10/1996 |
| JP | 2003-265682 | | 9/2003 |
| JP | 2004-275536 | | 10/2004 |
| KR | 2001-0084838 | | 9/2001 |
| KR | 2002-0061793 | | 7/2002 |
| KR | 2003-0091635 | | 12/2003 |
| KR | 200335819 | | 12/2003 |
| KR | 10-0819009 | B1 | 4/2008 |
| WO | WO 97/36658 | | 10/1997 |
| WO | WO 00/22585 | | 4/2000 |
| WO | WO 02/05914 | A1 | 1/2002 |
| WO | WO 02/051512 | A2 | 7/2002 |
| WO | 02/101630 | A1 | 12/2002 |
| WO | WO 03/004116 | A1 | 1/2003 |
| WO | 2005/035084 | | 4/2005 |
| WO | WO 2006/039308 | A2 | 4/2006 |
| WO | 2006/110348 | | 10/2006 |
| WO | 2007/033207 | A2 | 3/2007 |

OTHER PUBLICATIONS

U.S. Appl. No. 10/902,436, filed Jul. 29, 2004, Soltys et al.
U.S. Appl. No. 10/962,166, filed Oct. 8, 2004, Soltys et al.
U.S. Appl. No. 11/059,743, filed Feb. 16, 2005, Soltys et al.
U.S. Appl. No. 11/112,793, filed Apr. 21, 2005, Soltys et al.
U.S. Appl. No. 11/337,375, filed Jan. 23, 2006, Soltys et al.
U.S. Appl. No. 11/352,416, filed Feb. 10, 2006, Soltys.
U.S. Appl. No. 11/428,240, filed Jun. 30, 2006, Fleckenstein.
U.S. Appl. No. 11/428,253, filed Jun. 30, 2006, Fleckenstein.
U.S. Appl. No. 11/428,264, filed Jun. 30, 2006, Soltys.
U.S. Appl. No. 11/428,286, filed Jun. 30, 2006, Soltys et al.
U.S. Appl. No. 11/437,590, filed May 19, 2006, Soltys et al.
U.S. Appl. No. 11/478,360, filed Jun. 29, 2006, Fleckenstein.
U.S. Appl. No. 11/479,930, filed Jun. 30, 2006, Soltys et al.
U.S. Appl. No. 11/479,963, filed Jun. 29, 2006, Fleckenstein.
U.S. Appl. No. 11/479,991, filed Jun. 29, 2006, Soltys.
U.S. Appl. No. 11/480,273, filed Jun. 30, 2006, Soltys.
U.S. Appl. No. 11/480,274, filed Jun. 30, 2006, Huizinga.
U.S. Appl. No. 11/480,275, filed Jun. 30, 2006, Fleckenstein.
U.S. Appl. No. 11/480,295, filed Jun. 29, 2006, Fleckenstein.
U.S. Appl. No. 11/480,321, filed Jun. 30, 2006, Soltys.
U.S. Appl. No. 11/480,345, filed Jun. 30, 2006, Fleckenstein.
U.S. Appl. No. 11/480,349, filed Jun. 30, 2006, Soltys et al.
U.S. Appl. No. 11/519,244, filed Sep. 11, 2006, Soltys et al.
U.S. Appl. No. 60/501,489, filed Sep. 8, 2003, Soltys et al.
U.S. Appl. No. 60/838,280, filed Aug. 17, 2006, Soltys et al.
Burke, A., "Tracking the Tables," reprinted from *International Gaming & Wagering Business*, Aug. 2003, 4 pages.
Griffin, P., *The Theory of Blackjack*, GBC Press, Las Vegas, Nevada, 1979, 190 pages.
Gros, R., "All You Ever Wanted to Know About Table Games," reprinted from *Global Gaming Business*, Aug. 1, 2003, 2 pages.
Scarne, J., *Scarne's New Complete Guide to Gambling*, Simon & Schuster, Inc., New York, 1974, pp. 358-359.
Terdiman, D., "Who's Holding the Aces Now?", reprinted from *Wired News*, Aug. 18, 2003, 2 pages.
Winkler, C., "Product Spotlight: MindPlay," reprinted from *Gaming and Leisure Technology*, Fall 2003, 2 pages.
Bally Technologies, "Introducing the New Bally Alpha Elite™ S9C," 12 pages.
Bally TMS, "MP21—Automated Table Tracking/Features," 2 pages, Nov. 2005.
Bally TMS, "MPBacc—Specifications/Specifications," 2 pages, Nov. 2005.
Bally TMS, "MPLite—Table Management System/Features," 2 pages, Nov. 2005.
Captain Morgan's Casino, Inc., "Blazing Sevens," accessed Oct. 31, 2006, URL=http://www.captainmorganscasino.com/casino-games/blazing-seven, 1 page.
International Guild of Hospitality & Restaurant Managers, "Shuffle Master, Inc. (NasdaqNM:SHFL)," accessed Dec. 30, 2003, URL=http://hospitalityguide.com/Financial/Casinos/Shuffle.htm, 3 pages.

(56) References Cited

OTHER PUBLICATIONS

Mikohn, "Mikohn Tablelink—The Industry's Premier Table Tracking Solution Delivers Improvements Straight to the Bottom Line," 2 pages, before Jan. 1, 2004.
Mikohn, "Tablelink™, The New Standard in Table Games," before Jan. 1, 2004, 14 pages.
Plaintiffs Declaration of Lawrence Luciano in Opposition to Shuffle Master's Motion for Preliminary Injunction, *Card, LLC* v. *Shuffle Master, Inc.*, D. Nev. (No. CV-N-03-0244-ECR-(RAM)), Nov. 24, 2003.
Shuffle Master, Inc., "Shuffle Master Announces New Products; Intelligent Table System to be Debuted at G2E," Sep. 10, 2003, 2 pages.
Video Slot Machines, "Bally Gaming: Blazing Sevens," accessed Jan. 5, 2007, URL=http://www.videoslotmachines.com/bally/blazingsevens.htm, 1 page.
U.S. Appl. No. 11/558,409, filed Nov. 9, 2006, Soltys.
Bally Technologies, Inc., iVIEW, http://ballytech.com/systems/product.cfm?id=9, download date Nov. 6, 2007, 2 pages.
Humble, L., *The World's Greatest Blackjack Book*, Random House, Inc., New York, 1987, p. 182.
MagTek, "Port Powered Swipe Reader," Technical Reference Manual, Manual Part No. 99875094 Rev 12, Jun. 2003, 20 pages.
Soltys, "Systems, Methods and Articles to Facilitate Playing Card Games With Selectable Odds," Office Action mailed Sep. 10, 2009, for U.S. Appl. No. 11/428,264, 9 pages.
Soltys, "Systems, Methods and Articles to Facilitate Playing Card Games With Selectable Odds," Amendment dated Dec. 10, 2009, for U.S. Appl. No. 11/428,264, 9 pages.
Soltys, "Systems, Methods and Articles to Facilitate Playing Card Games With Selectable Odds," Final Office Action mailed Mar. 5, 2010, for U.S. Appl. No. 11/428,264, 10 pages.
Soltys, "Systems, Methods and Articles to Facilitate Playing Card Games With Selectable Odds," Response dated May 4, 2010, for U.S. Appl. No. 11/428,264, 13 pages.
Soltys, "Systems, Methods and Articles to Facilitate Playing Card Games With Selectable Odds," Advisory Action mailed May 21, 2010, for U.S. Appl. No. 11/428,264, 3 pages.
Soltys, "Systems, Methods and Articles to Facilitate Playing Card Games With Selectable Odds," Pre-Appeal Brief dated Jun. 18, 2010, for U.S. Appl. No. 11/428,264, 6 pages.
Soltys, "Systems, Methods and Articles to Facilitate Playing Card Games With Selectable Odds," Pre-Brief Appeal Conference Decision mailed Aug. 5, 2010, for U.S. Appl. No. 11/428,264, 2 pages.
Soltys, "Systems, Methods and Articles to Facilitate Playing Card Games With Selectable Odds," Office Action mailed Aug. 12, 2010, for U.S. Appl. No. 11/428,264, 10 pages.
Soltys, "Systems, Methods and Articles to Facilitate Playing Card Games With Selectable Odds," Amendment dated Nov. 4, 2010, for U.S. Appl. No. 11/428,264, 20 pages.
Soltys, "Systems, Methods and Articles to Facilitate Playing Card Games With Selectable Odds," Final Office Action mailed Jan. 25, 2011, for U.S. Appl. No. 11/428,264, 11 pages.
Soltys, "Systems, Methods and Articles to Facilitate Playing Card Games With Selectable Odds," Amendment dated Mar. 17, 2011, for U.S. Appl. No. 11/428,264, 14 pages.
Soltys, "Systems, Methods and Articles to Facilitate Playing Card Games With Selectable Odds," 2nd Pre-Appeal Brief dated Jun. 30, 2011, for U.S. Appl. No. 11/428,264, 6 pages.
Soltys, "Systems, Methods and Articles to Facilitate Playing Card Games With Selectable Odds," Office Action dated Jan. 15, 2010, for CN200680055398.2, 6 pages.
International Search Report and Written Opinion, mailed Jan. 22, 2007, for PCT/US2006/035330, 10 pages.
International Search Report and Written Opinion, mailed Apr. 23, 2008, for PCT/US2007/084308, 8 pages.
"BOB and LDAP," Gaming Standards Association, Fremont, California, 7 pages, Oct. 26, 2003.
"GSA Point-to-Point SOAP/HTTPS Transport and Security Specification v1.0.3," Gaming Standards Association TRANSPORT Technical Committee, 16 pages, Jun. 5, 2007.
Requirements document, "Game Authentication Terminal Program (GAT3)," to Gaming Standards Association, Aug. 2005, 27 pages.
Standards document, "Technical Standards for Gaming Devices and On-Line Slot Systems," to Nevada Gaming Commission and State Gaming Control Board, Aug. 17, 2005, 15 pages.
Bulaysky, J., "Tracking the Tables," Casino Journal, May 2004, pp. 44-47, accessed Dec. 21, 2005, URL=http://www.ascendgaming.com/cj/vendors_manufacturers_table/Trackin916200411141AM.htm, 5 pages.
Gwyddion User Guide, "False Color Mapping: Chapter 3. Getting Started," retrieved from URL=http://sourceforge.net/projects/gwyddion/files/user-guide/2007-06-28/gwyddion-user-guide-xhtml-2007-06-28.tar.gz/download, retrieved on Nov. 21, 2012, 2 pages.
Hung et al., "Performance Evaluation of the Least Conflict Sharable Spreading Code Assignment Algorithm," IEEE, 1996, 5 pages.
Olesiejuk, "Discovery Services for Gaming Devices on a Casino Floor," Gaming Standards Association, 3 pages, Mar. 12, 2007.
Soltys, "Systems, Methods and Articles to Facilitate Playing Card Games With Selectable Odds," Amendment After Notice of Allowance Under 37 CFR 1.312, dated Nov. 17, 2011, for U.S. Appl. No. 11/428,264, 10 pages.
Soltys, "Systems, Methods and Articles to Facilitate Playing Card Games With Selectable Odds," Notice of Allowance, mailed Aug. 23, 2011, for U.S. Appl. No. 11/428,264, 11 pages.

* cited by examiner

700

732

The selected options give the House a Theoretical Advantage of 0.7033%

722 CALCULATE BASIC STRATEGY 724

728

726 CANCEL DELETE UPDATE 730

702

DEFINITIONS

Desired THEORETICAL HOLD 0.7 704

Blazing Single 7s In All 6 Decks: 8 706

Blazing Double 7s In All 6 Decks: 5 708

Blazing Triple 7s In All 6 Decks: 3 710

Push Is Player Loss: ⊙ Yes ○ No 712

Push Is Player Loss With Any Blazing7: ○ Yes ⊙ No 714

Progressive Bonus Percent: 0.5 716

Progressive Starting Bonus: 1500 718

720

| | | | |
|---|---|---|---|
| 7 | - | - | 2 |
| 7 | 7 | - | 3 |
| 7 | 7 | 7 | 5 |
| 7 | 77 | - | 4 |
| 7 | 7 | 77 | 5 |
| 7 | 77 | 777 | 6 |
| 7 | 77 | 77 | 6 |
| 7 | 777 | - | 4 |
| 7 | 7 | 777 | 5 |
| 7 | 777 | 777 | 9 |
| 77 | - | - | 2 |
| 77 | 77 | - | 4 |
| 77 | 77 | 77 | 7 |
| 77 | 777 | - | 4 |
| 77 | 77 | 777 | 6 |
| 77 | 777 | 777 | 9 |
| 777 | - | - | 2 |
| 777 | 777 | - | 7 |
| 777 | 777 | 777 | 9 |

FIG. 7

1100

1102

Determine Number Of Bonus Playing Cards Of Each Type Or Bonus Value Based At Least In Part On Desired Theoretical Hold And On Whether A Push Is A Loss For A Player

FIG. 11

1200

1202

Determine Number Of Bonus Playing Cards Of Each Type Or Bonus Value Based At Least In Part On Desired Theoretical Hold And On Whether A Push With At Least One Bonus Playing Card Is A Loss For A Player

FIG. 12

1300

1302

Determine Number Of Bonus Playing Cards Of Each Type Or Bonus Value Based At Least In Part On Desired Theoretical Hold And On A Bonus Jackpot Parameter

FIG. 13

1400

1402

Determine Number Of Bonus Playing Cards Of Each Type Or Bonus Value Based At Least In Part On Desired Theoretical Hold And On An Amount Of Each Wager Allocated To The Bonus Jackpot

FIG. 14

1500

1502

Determine Number Of Bonus Playing Cards Of Each Type Or Bonus Value Based At Least In Part On Desired Theoretical Hold And On A Starting Amount Of The Bonus Jackpot

FIG. 15

SYSTEM, METHOD AND APPARATUS TO PRODUCE DECKS FOR AND OPERATE GAMES PLAYED WITH PLAYING CARDS

BACKGROUND OF THE INVENTION

1. Field of the Invention

This description generally relates to the field of table gaming and, more particularly, to games played with playing cards.

2. Description of the Related Art

There are numerous games played with playing cards. For example, blackjack, baccarat, various types of poker, LET IT RIDE®, and/or UNO®, to name a few. Games may be played with one or more standard decks of playing cards. A standard deck of playing cards typically comprises fifty-two playing cards, each playing card having a combination of a rank symbol and a suit symbol, selected from thirteen rank symbols (i.e., 2, 3, 4, 5, 6, 7, 8, 9, 10, J, Q, K, and A) and four suit symbols (i.e., ♥, ♣, ♦, and ♠). Some games may employ sets of playing cards including a fewer or a greater number of playing cards than those comprising a standard deck. Some games may include non-standard playing cards, for example playing cards with symbols other than the rank and suit symbols associated with a standard deck.

In some instances playing card games involve wagering, where money and/or prizes may be won. In other instances playing card games are played without wagering, for fun or recreation. In either case, it is typically desirable to randomize the set of playing cards before dealing the playing cards to the participants (e.g., players and/or dealer). Randomizing is typically referred to as shuffling, which describes the act of riffling or interleaving the corners of two stacks of playing cards by hand.

In other instances, it may be useful to arrange or otherwise sort playing cards into a defined order. For example, it may be desirable to form sorted packs or decks of playing cards after the playing cards are collected from one or more gaming tables in a casino. The packs or decks can then be checked for completeness, and reused, or sold.

Numerous devices and systems have been developed for automatically randomizing or sorting playing cards. One approach attempts to mechanically replicate riffling or interleaving the corners of two stacks of playing cards. Such an approach is shown, for example, in U.S. Pat. Nos. 4,807,884; 5,261,667; 5,275,411; and 5,303,921. Another approach is to separate the playing cards into two distinct stacks and randomly move playing cards from each stack into a third stack. Such an approach is shown, for example, in U.S. Pat. Nos. 5,695,189; 6,068,258; 6,139,014; 6,325,373; and 6,568,678. Yet another approach is to place playing cards into random positions in a stack of playing cards carried by an elevator. Such an approach typically involves a gripper mechanism to support an upper portion of the stack, while the floor of the elevator is dropped to create a space into which the playing card is inserted. Such an approach is shown, for example, in U.S. Pat. Nos. 5,683,085; 5,944,310; 6,651,981; and 6,651,982. A further approach is to insert playing cards into selected compartments, either randomly or in a sorted order. Such an approach is shown, for example, in U.S. Pat. Nos. 6,149,154; 6,254,096; 6,267,248; 6,588,750; 6,588,751; 6,655,684; 6,659,460; 6,676,127; and 6,889,979. Still a further approach is to withdraw or eject playing cards in a random order from an array of playing card receptacles. Such an approach is shown, for example, in U.S. Pat. Nos. 5,382,024; 5,584,483; 5,676,372; 6,019,368; 6,299,167; and 6,698,756.

Whether used for randomizing or sorting, card handling devices must deliver the randomized or sorted playing cards to the user (e.g., dealer). It will typically be desirable to present the playing cards in a highly aligned stack, in a manner that the playing cards are easily and quickly accessible by the user. This may be particularly desirable where the playing cards are delivered at a gaming table in a casino environment. Casinos highly value speed, which maintains customer interest, and which allows the maximum utilization of the casino facilities. Casinos also highly value security. Thus, casinos employ elaborate mechanisms and procedures to prevent players and/or casino personnel (e.g., dealers) from gaining a knowledge of a playing card value before the playing card is dealt. Consequently, devices and methods that facilitate the easy, quick, and secure delivery of playing cards are desirable.

SUMMARY OF THE INVENTION

In one embodiment, a system to form sets of playing cards includes an input subsystem configured to receive input indicative of at least one of a desired theoretical hold of a card game and a bonus game both played with playing cards from a set of playing cards, a rule of a game to be played with the set of playing cards or a progressive jackpot parameter; and a processing subsystem communicatively coupled to the input subsystem and configured to automatically determine a composition of the set of playing cards based at least in part on the received input, the set of playing cards including both a number of standard playing cards and a number of bonus playing cards.

In another embodiment, a method of forming a set of playing cards includes supplying a plurality of standard playing cards, each of the standard playing cards having a rank symbol indicative of a rank from a standard set of playing card ranks and a suit symbol indicative of a suit from a standard set of playing card suits; supplying at least a first bonus playing card having a first bonus symbol indicative of a first bonus value, at least one symbol on the first bonus playing card indicative of a rank from the standard set of playing card ranks; and supplying at least a second bonus playing card having a second bonus symbol indicative of a second bonus value, the second bonus symbol different from the first bonus symbol and the second bonus value different from the first bonus value, at least one symbol on the second bonus playing card indicative of a rank from the standard set of playing card ranks.

In a further embodiment, a set of playing cards includes a plurality of standard playing cards, each of the standard playing cards having a respective standard rank symbol and a standard suit symbol; a plurality of bonus playing cards, each of the bonus playing cards having a respective rank, the ranks of the plurality of bonus playing cards being equal to at least one of a set of standard ranks, where at least two of the bonus playing cards have different bonus values with respect to forming a bonus combination under the rules of a game played with the set of playing cards.

In another embodiment, a method of operating a card game played with a set of playing cards that includes a plurality of standard playing cards and a plurality of bonus playing cards, each of the standard playing cards having a respective standard rank symbol and a standard suit symbol, each of the bonus playing cards having a respective rank, the ranks of the plurality of bonus playing cards being equal to at least one of a set of standard ranks, where at least two of the bonus playing cards have different bonus values with respect to forming a bonus combination under the rules of a game played with the set of playing cards, includes for any winning hands under a set of rules of an underlying card game, paying a standard payout amount based on a standard payout schedule for the underlying card game; and for any winning hands under the set of rules of the underlying card game that contain at least one bonus playing card, paying a bonus amount based on a bonus payout schedule.

In yet a further embodiment, a system of operating a card game played with a set of playing cards that includes a plurality of standard playing cards, each of the standard playing cards having a respective standard rank symbol and standard suit symbol and a plurality of bonus playing cards, each of the bonus playing cards having a respective rank, the ranks of the plurality of bonus playing cards being equal to at least one of a set of standard ranks, where at least two of the bonus playing cards have different bonus values with respect to forming a bonus combination under the rules of a game played with the set of playing cards, includes a wager recognition subsystem that automatically identifies an amount of each of a respective wager placed by each of a number of players; a wager allocation subsystem that automatically allocates a portion of the wager placed by each of the players to a bonus jackpot pool; a bonus event subsystem that automatically determines when a bonus event occurs; and a bonus jackpot award subsystem that awards the bonus jackpot pool to a player having winning hand that includes a first number of a first type of bonus playing card when the bonus event occurs.

BRIEF DESCRIPTION OF THE DRAWINGS

In the drawings, identical reference numbers identify similar elements or acts. The sizes and relative positions of elements in the drawings are not necessarily drawn to scale. For example, the shapes of various elements and angles are not drawn to scale, and some of these elements are arbitrarily enlarged and positioned to improve drawing legibility. Further, the particular shapes of the elements as drawn, are not intended to convey any information regarding the actual shape of the particular elements, and have been solely selected for ease of recognition in the drawings.

FIG. 7 is a schematic diagram of a user interface allowing the input of information such as desired theoretical hold, game rules, and bonus parameter; and to display output, such as the composition of a set of playing cards, to achieve the desired theoretical hold, according to one illustrated embodiment.

FIG. 11 is a flow diagram illustrating a method of determining a number of bonus playing cards of each type or bonus values to be included in the set of playing cards, according to another illustrated embodiment.

FIG. 12 is a flow diagram illustrating a method of determining a number of bonus playing cards of each type or bonus values to be included in the set of playing cards, according to yet another illustrated embodiment.

FIG. 13 is a flow diagram illustrating a method of determining a number of bonus playing cards of each type or bonus values to be included in the set of playing cards, according to still another illustrated embodiment.

FIG. 14 is a flow diagram illustrating a method of determining a number of bonus playing cards of each type or bonus values to be included in the set of playing cards, according to yet another illustrated embodiment.

FIG. 15 is a flow diagram illustrating a method of determining a number of bonus playing cards of each type or bonus values to be included in the set of playing cards, according to yet still another illustrated embodiment.

DETAILED DESCRIPTION OF THE INVENTION

Figure 1:
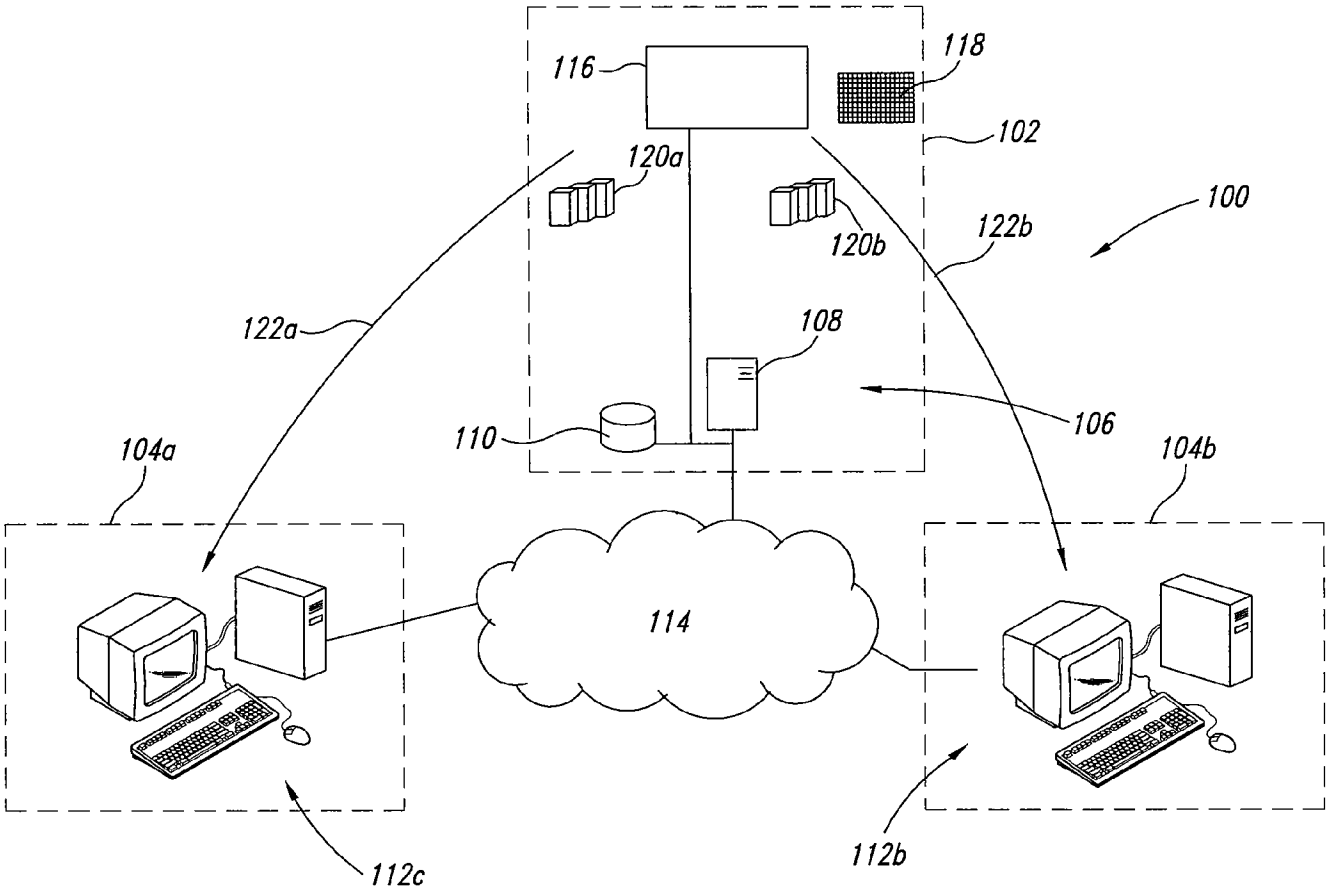
FIG. 1 is a schematic diagram of a playing card order and distribution environment, according to one illustrated embodiment.

In the following description, certain specific details are set forth in order to provide a thorough understanding of various embodiments of the invention. However, one skilled in the art will understand that the invention may be practiced without these details. In other instances, well-known structures associated with computers, computer networks, communications interfaces, sensors and/or transducers, printers, and/or presses may not be shown or described in detail to avoid unnecessarily obscuring the description.

Unless the context requires otherwise, throughout the specification and claims which follow, the word "comprise" and variations thereof, such as, "comprises" and "comprising" are to be construed in an open, inclusive sense, that is as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

The headings provided herein are for convenience only and do not interpret the scope or meaning of the claimed invention.

This description generally relates to a playing card ordering and distribution environment that allows entities, for example casinos or other gaming establishments, to order sets of playing cards to implement various table games with bonus features having desired theoretical holds. A theoretical hold represents that portion of each dollar wagered that the gaming establish will statistically retain. While the amount that an entity will actually hold may fluctuate, and may never actually match the theoretical hold, the theoretical hold provides an approximation of the amount that a gaming establishment will retain over the long term.

For purposes of clarity and brevity, the description herein may reference certain card games such as blackjack, baccarat, various types of poker, or LET IT RIDE®. However, it is understood and appreciated that this description is generally applicable to a variety of casino-type games and/or gaming tables, or may be generally applicable to other recreational card games. The playing card handling system described herein may be useful in wagering type card games and non-wagering type card games.

In addition, it is understood that the playing cards described herein do not necessarily correspond to the standard playing cards, for example cards that are larger or smaller, shaped differently, and/or made from something other than traditional card stock material. Playing cards may include one or more decks of standard playing cards, where each standard deck includes fifty-two (52) playing cards. Standard playing cards typically have uniform backs, and faces which each bear a respective combination of a first primary symbol and a second primary symbol. The first primary symbol may be selected from a standard set of playing card rank symbols (i.e., 2, 3, 4, 5, 6, 7, 8, 9, 10, J, Q, K, and A) and the second primary symbol may be selected from a standard set of playing card suit symbols (i.e., ♥, ♣, ♦, and ♠). In some embodiments, the playing cards may include playing cards other than those found in a complete standard deck, or decks with a greater or less distribution of particular playing cards, for example less face cards or more face cards. In other embodiments, the playing cards may have non-standard symbols (e.g., slot machine symbols such as bars, lemons, cherries), graphics, backings, etc. As discussed below, the symbols may even be modified to add, enhance, or alter the value or significance of the playing card. In one embodiment, the playing cards are dual sided playing cards as described in U.S. patent application Ser. No. 10/902,436, which published on Jun. 2, 2005.

Brief Overview of the Playing Card Order and Distribution Environment

FIG. 1 shows a playing card order and distribution environment 100, according to one illustrated embodiment.

The playing card order and distribution environment 100 may include a playing card forming entity, for example a playing card manufacturer 102. The playing card order and distribution environment 100 may include and one or more playing card using entities, for example one or more casinos or gaming establishments 104*a*, 104*b* (collectively 104).

The playing card manufacturer 102 may operate or otherwise access a playing card composition computing system 106. The playing card composition computing system 106 may include one or more computers 108 and one or more databases 110. The casinos 104 may each operate or otherwise access one or more casino computing systems 112*a*, 112*b*, (collectively 112), which are communicatively coupled to the playing card composition computing system 106 by one or more networks 114. As discussed herein, the playing card composition computing system 106 allows the casinos 104 to determine the composition of sets of playing cards which will provide a desired theoretical hold for card games with bonus options, by specifying the desired theoretical holds, rule(s) of the card game, and/or bonus related parameters.

The composition of a set of playing cards may include an indication of the total number of playing cards in the set and the number and distribution of various standard playing cards in the set, as well as the number and distribution of various bonus playing cards in the set. In some embodiments, the sets may include 52 playing cards. In other embodiments, the sets may include a greater number of playing cards. For example, some embodiments may employ integer multiples of 52 playing cards. Some embodiments may employ a smaller number of playing cards, or non-integer multiples of 52 playing cards.

The playing card manufacturer 102 may operate or otherwise access a playing card forming system 116. The playing card forming system 116 may include one or more printers or presses (e.g., offset, lithographic, screen print) configured to print or otherwise form playing cards, for example as sheets of playing cards 118. The playing card manufacturer 102 may operate or otherwise employ suitable equipment such as cutting machines to cut the sheets 118 to form individual playing cards. The playing card manufacturer 102 may form or collate and/or package the individual playing cards into sets of playing cards 120*a*, 120*b* (collectively 120) having the determined composition. The playing card manufacturer 102 may deliver sets of playing cards 120, as indicated by arrows 122*a*, 122*b* (collectively 122) to the casinos 104.

While FIG. 1 and the above discussion locates the playing card composition computing system 106 with the playing card manufacturer 102, in some embodiments the playing card composition computing system 106 may be located with the casinos 104 or may be located or operated with some other entity. In some embodiments, some portion(s) of the playing card composition computing system 106 or function(s) thereof may be located with the playing card manufacturer 102, while other portion(s) of the playing card composition computing system 106 or function(s) thereof may be located with the casinos 104 or may be located or operated via some other entity.

Figure 2:
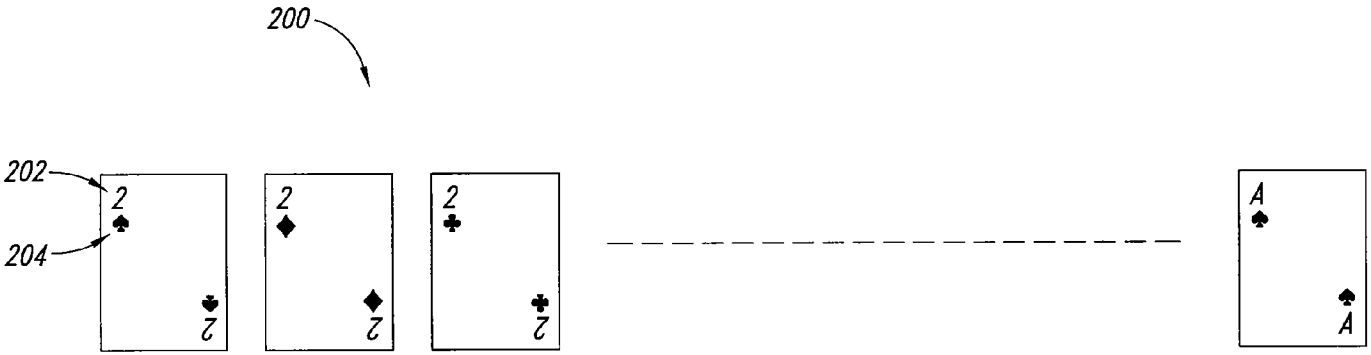
FIG. 2 is a front plan view of a plurality of standard playing cards bearing standard rank and suit markings, according to one illustrated embodiment.

FIG. 2 shows a set of standard playing cards 200, according to one illustrated embodiment.

The playing cards 200 each bear a rank symbol 202 (only one called out in FIG. 2) and a suit symbol 204 (only one called out in FIG. 2). The rank symbol 202 may be selected from a set of standard rank symbols (i.e., 2, 3, 4, 5, 6, 7, 8, 9, 10, J, Q, K, and A). In some embodiments, the rank symbol 202 may be selected from less than the full set of standard rank symbols (i.e., 2, 3, 4, 5, 6, 8, 9, 10, J, Q, K, and A). The suit symbol 204 may be selected from a set of standard suit symbols (i.e., ♥, ♣, ♦, and ♠). Some embodiments may omit the suit symbol entirely. For example, the suit symbol may be omitted in some embodiments where the card game does not employ the suit, for instance blackjack. In some embodiments, the sets of playing cards 120 (FIG. 1) may include multiple instances of playing cards have identical rank and suit combinations, or may omit some rank and suit combinations.

Figure 3:
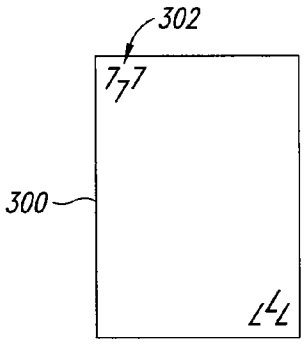
FIG. 3 is a front plan view of a first bonus playing card of a first bonus value and having a marking indicating a rank selected from a set of standard playing card ranks, according to one illustrated embodiment.

FIG. 3 shows a first bonus playing card 300, according to one illustrated embodiment.

The first bonus playing card 300 may include a symbol 302 that represents a rank. The rank may be selected from the set of standard ranks (i.e., 2, 3, 4, 5, 6, 7, 8, 9, 10, J, Q, K, and A). As illustrated, the symbol 302 is indicative of the rank of 7. The symbol 302, or another symbol, may also be indicative of a bonus value of the bonus playing card 300 in forming a bonus combination that entitles a player to a bonus payout. As illustrated, the first bonus playing card 300 is illustrative of a triple 7 bonus value. In some embodiments, the bonus playing card 300 may omit any symbol indicative of suit. Such may be particularly suitable for use in play of underlying card games that do not employ suit, for example blackjack or baccarat. In other embodiments, the bonus playing card 300 may include a symbol indicative of suit. Such may be particularly suitable for use in play of underlying card games that employ suit, for example various forms of poker.

Figure 4:
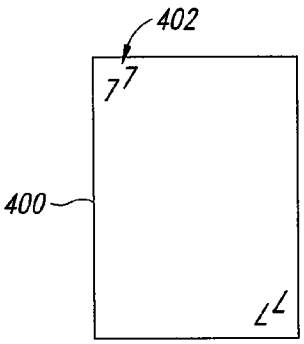
FIG. 4 is a front plan view of a second bonus playing card of a second bonus value and having a marking indicating a rank selected from a set of standard playing card ranks, according to one illustrated embodiment.

FIG. 4 shows a second bonus playing card 400, according to one illustrated embodiment.

The second bonus playing card 400 may include a symbol 402 that represents a rank. The rank may be selected from the set of standard ranks (i.e., 2, 3, 4, 5, 6, 7, 8, 9, 10, J, Q, K, and A). The rank may advantageously be equal to the rank of the first bonus playing card 300. As illustrated, the symbol 402 is indicative of the rank of 7. The symbol 402, or another symbol, may also be indicative of a bonus value of the playing card 400 in forming a bonus combination that entitles a player to a bonus payout. As illustrated, the second bonus playing card 400 is illustrative of a double 7 bonus value.

Figure 5:
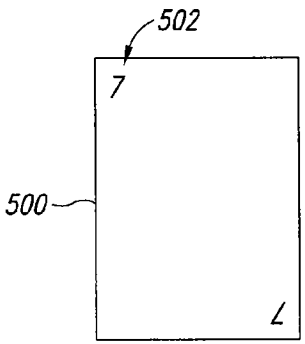
FIG. 5 is a front plan view of a third bonus playing card of a third bonus value and having a marking indicating a rank selected from a set of standard playing card ranks, according to one illustrated embodiment.

FIG. 5 shows a third bonus playing card 500, according to one illustrated embodiment.

The third bonus playing card 500 may include a symbol 502 that represents a rank. The rank may be selected from the set of standard ranks (i.e., 2, 3, 4, 5, 6, 7, 8, 9, 10, J, Q, K, and A). The rank may advantageously be equal to the rank of the first and the second bonus playing cards 300, 400, respectively. As illustrated, the symbol 502 is indicative of the rank of 7. The symbol 502, or another symbol, may also be indicative of a bonus value of the playing card 500 in forming a bonus combination that entitles a player to a bonus payout. As illustrated, the third bonus playing card 500 is illustrative of a single 7 bonus value.

Computing Environment

Figure 6:
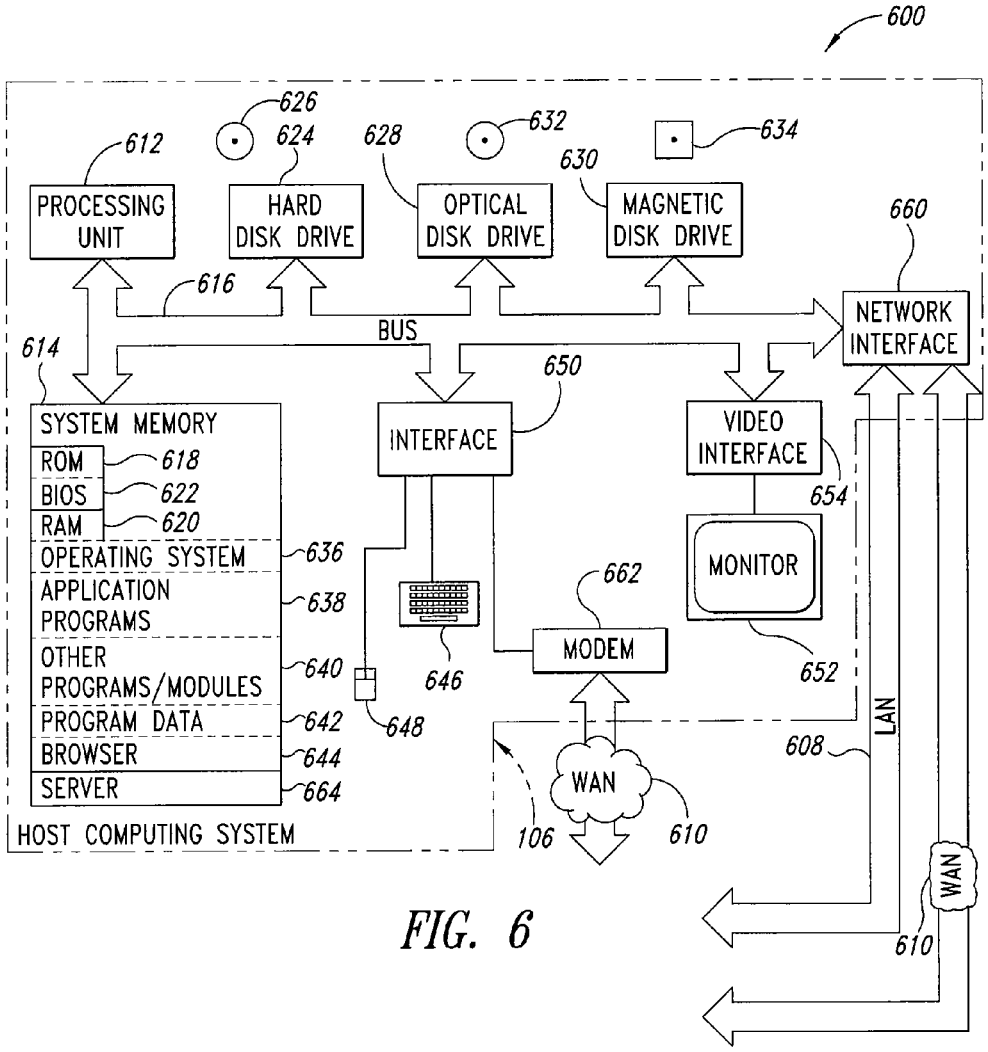
FIG. 6 is a block diagram of a computing system useful in implementing the playing card order and distribution environment of FIG. 1, according to one illustrated embodiment.

FIG. 6 and the following discussion provide a brief, general description of a suitable computing environment 600 in which the various illustrated embodiments can be implemented. Although not required, the embodiments will be described in the general context of computer-executable instructions, such as program application modules, objects, or macros being executed by a computer. Those skilled in the relevant art will appreciate that the illustrated embodiments, as well as other embodiments, can be practiced with other computer system configurations, including hand-held devices, multiprocessor systems, microprocessor-based or programmable consumer electronics, personal computers ("PCs"), network PCs, mini computers, mainframe computers, and the like. The embodiments can be practiced in distributed computing environments where tasks or modules are performed by remote processing devices, which are linked through a communications network. In a distributed computing environment, program modules may be located in both local and remote memory storage devices.

FIG. 6 shows the computing environment 600 comprising one or more playing card composition computing systems 106, which may be communicatively coupled to the casino computing systems 112 and/or playing card forming system 116 by one or more communications channels, for example one or more local area networks (LANs) 608 or wide area networks (WANs) 610. The computing environment 600 may employ other computers, such as conventional personal computers, where the size or scale of the system allows.

The playing card composition computing system 106 may take the form of a conventional mainframe or mini-computer, that includes a processing unit 612, a system memory 614, and a system bus 616 that couples various system components including the system memory 614 to the processing unit 612. The playing card composition computing system 106 will at times be referred to in the singular herein, but this is not intended to limit the embodiments to a single playing card composition computing system 106 since in typical embodiments, there will be more than one playing card composition computing system 106 or other device involved.

The processing unit 612 may be any logic processing unit, such as one or more central processing units (CPUs), digital signal processors (DSPs), application-specific integrated circuits (ASICs), etc. Unless described otherwise, the construction and operation of the various blocks shown in FIG. 6 are of conventional design. As a result, such blocks need not be described in further detail herein, as they will be understood by those skilled in the relevant art.

The system bus 616 can employ any known bus structures or architectures, including a memory bus with memory controller, a peripheral bus, and a local bus. The system memory 614 includes read-only memory ("ROM") 618 and random access memory ("RAM") 620. A basic input/output system ("BIOS") 622, which can form part of the ROM 618, contains basic routines that help transfer information between elements within the playing card composition computing system 106, such as during start-up.

The playing card composition computing system 106 also includes a hard disk drive 624 for reading from and writing to a hard disk 626, and an optical disk drive 628 and a magnetic disk drive 630 for reading from and writing to removable optical disks 632 and magnetic disks 634, respectively. The optical disk 632 can be a CD-ROM, while the magnetic disk 634 can be a magnetic floppy disk or diskette. The hard disk drive 624, optical disk drive 628, and magnetic disk drive 630 communicate with the processing unit 612 via the system bus 616. The hard disk drive 624, optical disk drive 628, and magnetic disk drive 630 may include interfaces or controllers (not shown) coupled between such drives and the system bus 616, as is known by those skilled in the relevant art. The drives 624, 628 and 630, and their associated computer-readable media 626, 632, 634, provide nonvolatile storage of computer readable instructions, data structures, program modules, and other data for the playing card composition computing system 106. Although the depicted playing card composition computing system 106 employs hard disk 624, optical disk 628, and magnetic disk 630, those skilled in the relevant art will appreciate that other types of computer-readable media that can store data accessible by a computer may be employed, such as magnetic cassettes, flash memory cards, digital video disks ("DVD"), Bernoulli cartridges, RAMs, ROMs, smart cards, etc.

Program modules can be stored in the system memory 614, such as an operating system 636, one or more application programs 638, other programs or modules 640, and program data 642. The system memory 614 may also include communications programs, for example a Web client or browser 644 for permitting the playing card composition computing system 106 to access and exchange data with sources such as Web sites of the Internet, corporate intranets, or other networks as described below, as well as other server applications on server computing systems such as those discussed further below. The browser 644 in the depicted embodiment is markup language based, such as Hypertext Markup Language (HTML), Extensible Markup Language (XML), or Wireless Markup Language (WML), and operates with markup languages that use syntactically delimited characters added to the data of a document to represent the structure of the document. A number of Web clients or browsers are commercially available such as those from America Online and Microsoft of Redmond, Wash.

While shown in FIG. 6 as being stored in the system memory 614, the operating system 636, application programs 638, other programs/modules 640, program data 642, and browser 644 can be stored on the hard disk 626 of the hard disk drive 624, the optical disk 632 of the optical disk drive 628, and/or the magnetic disk 634 of the magnetic disk drive 630. An operator, such as authorized personnel of the playing card manufacturer or distributor, can enter commands and information into the playing card composition computing system 106 through input devices such as a touch screen or keyboard 646 and/or a pointing device such as a mouse 648. Other input devices can include a microphone, joystick, game pad, tablet, scanner, etc. These and other input devices are connected to the processing unit 612 through an interface 650 such as a serial port interface that couples to the system bus 616, although other interfaces such as a parallel port, a game port, a wireless interface, or a universal serial bus ("USB") can be used. A monitor 652 or other display device is coupled to the system bus 616 via a video interface 654, such as a video adapter. The playing card composition computing system 106 can include other output devices, such as speakers, printers, etc.

The playing card composition computing system 106 can operate in a networked environment using logical connections to one or more remote computers and/or devices, for example the casino computing systems 112 via one or more servers, hubs, routers, etc. The server can be another personal computer, a server, another type of computer, or a collection of more than one computer communicatively linked together, and typically includes many or all of the elements described above for the playing card composition computing system 106. The server may be logically connected to one or more of the playing card composition computing system 106 under any known method of permitting computers to communicate, such as through one or more LANs 608 and/or WANs 610 such as the Internet. Such networking environments are well known in wired and wireless enterprise-wide computer networks, intranets, extranets, and the Internet. Other embodiments include other types of communication networks including telecommunications networks, cellular networks, paging networks, and other mobile networks.

When used in a LAN networking environment, the playing card composition computing system 106 is connected to the LAN 608 through an adapter or network interface 660 (communicatively linked to the system bus 616). When used in a WAN networking environment, the playing card composition computing system 106 may include a modem 662 or other device, such as the network interface 660, for establishing communications over the WAN 610. The modem 662 is shown in FIG. 6 as communicatively linked between the interface 650 and the WAN 610. In a networked environment, program modules, application programs, or data or portions thereof, can be stored in the playing card composition computing system 106. As noted above, the playing card composition computing system 106 may be communicatively linked to the casino computing systems 112 and/or playing card forming system 116 through the LANs 608 and/or WAN 610, for example with TCP/IP middle layer network protocols. However, other similar network protocol layers are used in other embodiments, such as User Datagram Protocol ("UDP"). Those skilled in the relevant art will readily recognize that the network connections shown in FIG. 6 are only some examples of establishing communication links between computers, and other links may be used, including wireless links.

In some embodiments, the playing card composition computing system 106 includes server applications 664 for the routing of instructions, programs, data, and agents between the casino computing systems 112 and/or playing card forming system 116. For example the server applications 664 may include conventional server applications such as WINDOWS NT 4.0 Server, and/or WINDOWS 2000 Server, available from Microsoft Corporation of Redmond, Wash. Additionally, or alternatively, the server applications 664 can include any of a number of commercially available Web servers, such as INTERNET INFORMATION SERVICE from Microsoft Corporation and/or IPLANET from Netscape.

It is understood that any suitable processor based system may be employed in the playing card composition computing system 106. The processing system may be a specially designed and/or fabricated processing system, or a commercially available processor system. Non-limiting examples of commercially available processor systems include, but are not limited to, an 80×86 or Pentium series microprocessor from Intel Corporation, U.S.A., a PowerPC microprocessor from IBM, a Spare microprocessor from Sun Microsystems, Inc., a PA-RISC series microprocessor from Hewlett-Packard Company, or a 68xxx series microprocessor from Motorola Corporation.

FIG. 7 shows a user interface 700 to facilitate the determination of the composition of playing card sets 120 (FIG. 1), according to one illustrated embodiment.

The user interface 700 may include one or more displays and user input devices, such as those of the casino computing systems 112 (FIG. 1). The displays may take the form of touch screen displays. Alternatively, or additionally, the user interface 700 may employ a separate user input device, for example a keyboard or keypad. The user interface 700 may further include one or more sound transducers, such as a speaker and/or microphone. The user interface 700 may include one or more controllers, memories, and/or other devices, and may store and execute one or more applications for providing information to, and collecting information from, the users. Additionally, the user interface 700 may include instructions for handling security such as password or other access protection and communications encryption.

The user interface may include a GUI 702 that allows casino personnel or others to select or enter various options or parameters in order to determine a composition of a set of cards to produce a card game with a bonus option that provides a desired theoretical hold or house advantage.

For example, the GUI 702 may include a desired theoretical hold field 704, to allow the user to select or enter a desired theoretical hold. The GUI 702 may provide a number of predefined theoretical holds or house advantages, or may receive any desired theoretical hold or house advantage defined by the user.

Also for example, the GUI 702 may include a single bonus value field 706, to allow the user to select or enter a value indicative of a total number of bonus playing cards (e.g., 500, FIG. 5) of a single bonus value (e.g., 502) to be included in the set of playing cards 120 (FIG. 1). Also for example, the GUI 702 may include a double bonus value field 708, to allow the user to select or enter a value indicative of a total number of bonus playing cards (e.g., 400, FIG. 4) of a double bonus value (e.g., 402) to be included in the set of playing cards 120. Also for example, the GUI 702 may include a triple bonus value field 710, to allow the user to select or enter a value indicative of a total number of bonus playing cards (e.g., 300, FIG. 3) having a triple bonus value (e.g., 302) to be included in the set of playing cards 120. The GUI 702 may include additional fields to allow the specification of bonus playing cards of additional or other bonus values.

The GUI 702 may also permit the user to select from a variety of game rules or options for the underlying card game. For example, the GUI 702 may include a push field 712, to allow the user to indicate whether a tie or "push" is considered to be a loss to a player. Additionally, or alternatively, the GUI 702 may include a push with bonus card field 714, to allow the user indicate whether a tie or "push" with a bonus playing card (e.g., 300, 400, 500) in the hand is considered to be a loss to a player. The GUI 702 may include additional fields for specifying game parameters. For example, the GUI 702 may include one or more fields that allow the user to select between various card games, for example blackjack, baccarat, and/or various types of poker.

The GUI 702 may also permit the players 1710 to select from a variety of bonus and/or progressive gaming options or parameters. For example, the GUI 702 may include an allocation field 716, to allow the user to select or enter an amount of each wager to be allocated to a progressive jackpot. The amount may, for example, be represented as a percentage of each wager on the underlying card game that will be allocated to the bonus jackpot or pool. Also for example, the GUI 702 may include a starting bonus field 718, to allow the user to select or enter a progressive starting bonus amount. The GUI may include additional fields to allow the specification of other bonus parameters.

A frequency table 720 provides an indication of the statistical likelihood of various combinations of bonus playing cards 300, 400, 500 appearing over the course of play with the set of playing cards 120 having the specified composition. For example, a hand with a single bonus playing card 500 of the third bonus value 502 will likely occur twice (first row of table), while a hand with a pair of bonus playing cards 500 of the third bonus value 502 will occur three times (second row of table).

The GUI 702 may include a variety of user selectable icons to allow the user to operate and control the GUI 702. For example, a calculate icon 722 allows the user to calculate a theoretical hold for a given set of parameters. Selection of a basic strategy icon 724 produces a chart or list of all possible playing card combinations (e.g., hands of standard and/or bonus playing cards) and the best player action (e.g., hit or stand) given the particular combination hit. The basis strategy determination takes into account the underlying card game, the payout table of the bonus game, and any changes to the composition of the standard playing cards 200 (e.g., fewer or greater number of standard playing cards) may have on the outcome. A cancel icon 726 allows the user to cancel the current determination and underlying parameters of all fields or selections. A delete field 728 allows the user to delete one or more parameters of a currently selected field or icon. An update field 730 allows the user to save and name a current configuration (i.e., composition, game rule(s), bonus parameter(s)). A theoretical advantage field 732 displays the determined theoretical advantage enjoyed by the house for a given set of parameters. The GUI 702 may also allow the user to specify text, graphics, and/or formatting to customize the set of playing cards 120, for example for a specific gaming establishment or event (e.g., tournament, convention, show, promotion).

Operation

Figure 8:
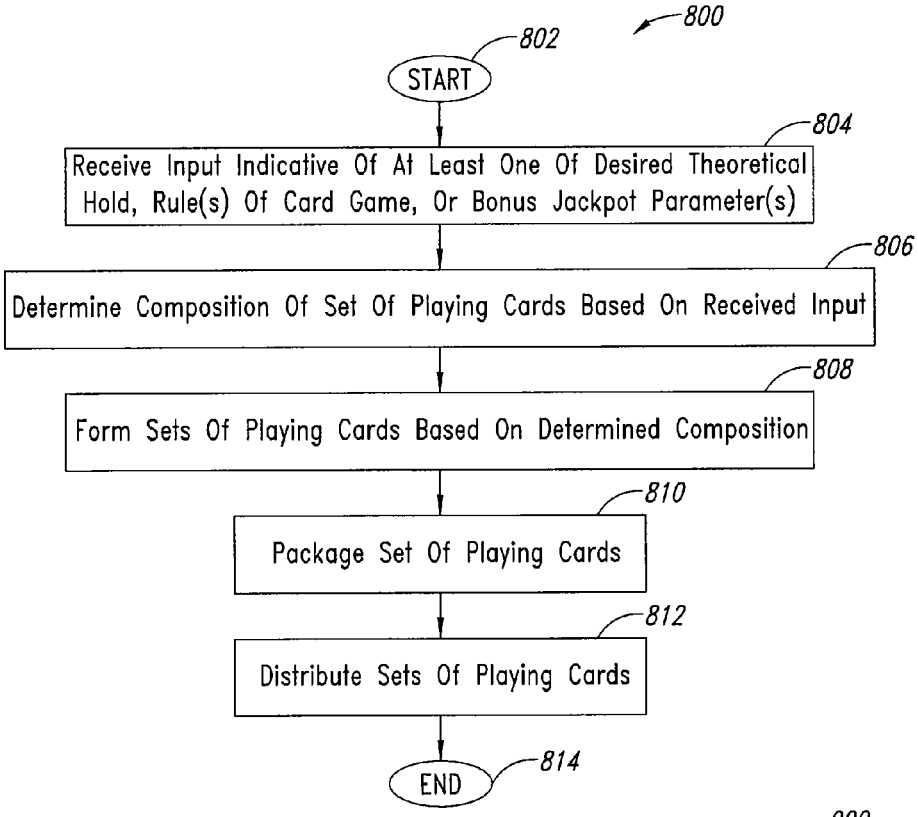
FIG. 8 is a flow diagram illustrating a method of operating a playing card order and distribution environment, according to one illustrated embodiment.

FIG. 8 shows a method 800 of producing sets of playing cards 120, according to one illustrated embodiment.

The method 800 starts at 802. For example, the method 800 may start in response to casino personnel accessing the playing card composition computing system 106 (FIG. 1) via the casino computing system 112.

At 804, the playing card composition computing system 106 receives input indicative of at least one of a desired theoretical hold, rule(s) of a card game, and/or bonus jackpot parameter(s). The desired theoretical hold may, for example, represent a desired amount of each dollar wagered that the casino or other gaming establishment would statistically retain over the long term. The desired theoretical hold may, for example, be represented as a percentage. The card game rules may, for example, indicate the type of card game (e.g., blackjack, baccarat, poker, etc.) and/or specific rules of the card game. The bonus jackpot parameters may, for example, indicate an amount of each wager on the underlying card game that will be allocated to a jackpot bonus or pool, and/or may indicate a starting amount of the jackpot bonus or pool.

At 806, the playing card composition computing system 106 determines the composition of the set of playing cards 120 based on the received input. The playing card composition computing system 106 may execute a set of instructions that employ a statistical package to determine the composition of the set of playing cards 120. As previously noted, the composition may include the total number of playing cards in the set of playing cards 120, and the number and types of bonus playing cards 300, 400, 500 in the set of playing cards 120, as well as the number of standard playing cards 200 in the set of playing cards 120. The playing card composition computing system 106 may determine a composition that produces the desired theoretical hold based on the theoretical hold of the underlying card game, and the theoretical hold of the bonus game. Where the bonus playing cards substitute for standard playing cards of like rank, the theoretical hold of the underlying card game is not effected by the use of bonus playing cards. Thus, the desired theoretical hold will be a function of the percentage of the wagers that are allocated to the jackpot bonus or pool, the theoretical hold of the bonus game, and the unchanged theoretical hold of the underlying card game. Alternatively, or additionally, the playing card composition computing system 106 may determine the resulting theoretical hold based on a proposed composition of the set of playing cards, game rule(s), and/or bonus parameter(s). In such an embodiment, the casino personnel may iteratively determine the desired composition that will result in a desired theoretical hold.

The playing card composition computing system 106 may advantageously permit a theoretical hold to be set for a gaming establishment or even a specific one or more gaming tables 1702. The theoretical hold represents the advantage of the house (e.g., casino) for a particular game. The theoretical hold is typically based on the combination of the card game rules and the casino rules, if any, and assumes that the participants play with perfect strategy. Participants rarely play with perfect strategy, hence the term "theoretical hold."

It is customary in most casinos to set a theoretical hold of at least 0.5%, which may be referred to as a "positive hold" and means that the house would earn 0.5% of every dollar wagered for the particular game. For some games, like LET IT RIDE® for example, the theoretical hold can be as high as 30%.

Accordingly, the casino could entice players to play at a table with a larger than customary theoretical hold by providing large incentives for participants that did well against the house on such a table.

By way of another non-limiting example, the casino could set the theoretical hold to favor the participants, instead of the house. This type of gaming table 102 would have a "negative theoretical hold." One reason for having a negative theoretical hold would be to attract beginner players that may not want to wager a lot, but are also not willing to lose a lot either. Thus, the gaming table 1702 with the negative hold would provide beginning players a chance to play the game for awhile, learn the game, and hopefully walk away feeling successful and possibly ready to play at more challenging tables. Based on the foregoing, the playing card composition computing system 106 could advantageously be used to set the theoretical hold within a range of −10% to 40%, for example. The negative percentages represent theoretical holds that favor the participants, while the positive percentages represent theoretical holds that favor the house. It is appreciated that the aforementioned theoretical hold range is not meant to limit the scope of this application and it is understood that the value of the theoretical hold for a particular gaming establishment or gaming table 1702 is solely within the discretion of the house.

At 808, the playing card manufacturer 102 (FIG. 1) forms sets of playing cards based on the determined composition. For example, the playing card manufacturer 102 may operate one or more playing card forming systems 116 to print sheets of playing cards 118. The playing card manufacturer 102 may operate one or more cutting machines to cut the sheets into individual playing cards. At 810, the playing card manufacturer 102 packages sets of playing cards 120. At 812, the playing card manufacturer 102 distributes 122 (FIG. 1) the packaged sets of playing cards. For example, the playing card manufacturer 102 may transport the sets of playing cards 120 by any known method of conveyance. In some embodiments, the composition of the set of playing cards 120 may be electronically distributed to one or more disparate locations for printing. In some embodiments, such locations may include casinos and other gaming establishments.

The method 800 terminates at 814.

Figure 9:
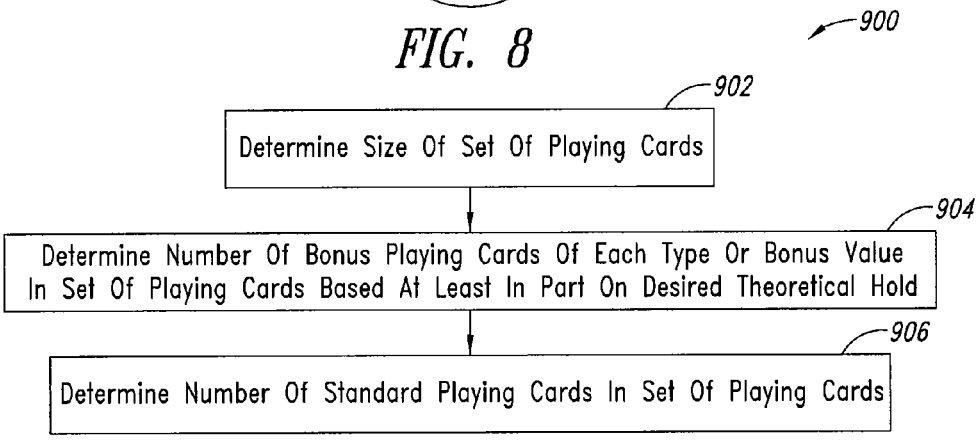
FIG. 9 is a flow diagram illustrating a method of determining a composition of a set of playing cards including a plurality of standard playing cards and bonus playing cards, according to one illustrated embodiment.

FIG. 9 shows a method 900 of determining a composition of a set of playing cards, according to one illustrated embodiment. The method 900 may be suitable for use in the method 800 (FIG. 8).

At 902, the playing card composition computing system 106 determines the size of a set of playing cards. At 904, the playing card composition computing system 106 determines the number of bonus playing cards 300, 400, 500 (FIGS. 3, 4, and 5) of each type or bonus value to be included in the set of playing cards 120, based at least in part on a desired theoretical hold. At 906, the playing card composition computing system 106 determines the number of standard playing cards 200 (FIG. 2) to be included in the set of playing cards 120.

Figure 10:
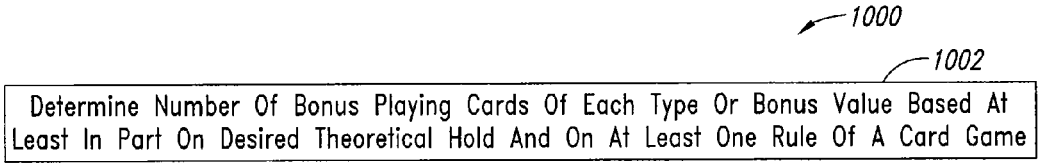
FIG. 10 is a flow diagram illustrating a method of determining a number of bonus playing cards of each type or bonus values to be included in the set of playing cards, according to one illustrated embodiment.

FIG. 10 shows a method 1000 of determining the number of bonus playing cards, according to one illustrated embodiment. The method 1000 may be suitable for use in the method 900 (FIG. 9).

At 1002, the playing card composition computing system 106 determines the number of bonus playing cards 300, 400, 500 (FIGS. 3, 4, and 5) of each type or bonus value based at least in part on a desired theoretical hold and on at least one rule of a card game.

FIG. 11 shows a method 1100 of determining the number of bonus playing cards to be included in the set of playing cards 120, according to another illustrated embodiment. The method 1100 may be suitable for use in the method 1000 (FIG. 10).

At 1102, the playing card composition computing system 106 determines the number of bonus playing cards 300, 400, 500 (FIGS. 3, 4, and 5) of each type or bonus value based at least in part on a desired theoretical hold and on whether a tie or push is treated as a loss for a player.

FIG. 12 shows a method 1200 of determining a number of bonus playing cards to be included the set of playing cards 120, according to another illustrated embodiment. The method 1200 may be suitable for use in the method 1000 (FIG. 10).

At 1202, the playing card composition computing system 106 determines the number of bonus playing cards 300, 400, 500 (FIGS. 3, 4, and 5) of each type or bonus value based at least in part on a desired theoretical hold and on whether a tie or push with at least one bonus playing card 300, 400, 500 (FIGS. 3, 4, and 5) is treated as a loss for a player.

FIG. 13 shows a method 1300 of determining a number of bonus playing cards to be included in the set of playing cards 120, according to another illustrated embodiment. The method 1300 may be suitable for use in the method 900 (FIG. 9).

At 1302, the playing card composition computing system 106 determines the number of bonus playing cards 300, 400, 500 (FIGS. 3, 4, and 5) of each type or bonus value to be included in the set of playing cards 120 based at least in part on a desired theoretical hold and on a bonus jackpot parameter.

FIG. 14 shows a method 1400 of determining the number of bonus playing cards to be included in the set of playing cards 120 based at least in part on a desired theoretical hold and a bonus jackpot parameter. The method 1400 may be suitable for use in the method 1300 (FIG. 13).

At 1402, the playing card composition computing system 106 determines the number of bonus playing cards 300, 400, 500 (FIGS. 3, 4, and 5) of each type or bonus value to be included in the set of playing cards 120 based at least in part on a desired theoretical hold and on an amount of each wager on the underlying card game that will be allocated to a bonus jackpot.

FIG. 15 shows a method 1500 of determining a number of bonus playing cards to be included in the set of playing cards 120 based at least in part on a desired theoretical hold and a bonus jackpot parameter, according to another illustrated embodiment. The method 1500 may be suitable for use in the method 1300 (FIG. 13).

At 1502, the playing card composition computing system 106 determines the number of bonus playing cards 300, 400, 500 (FIGS. 3, 4, and 5) of each type or bonus value to be included in the set of playing cards 120 based at least in part on a desired theoretical hold and on a starting amount of the bonus jackpot.

Figure 16:
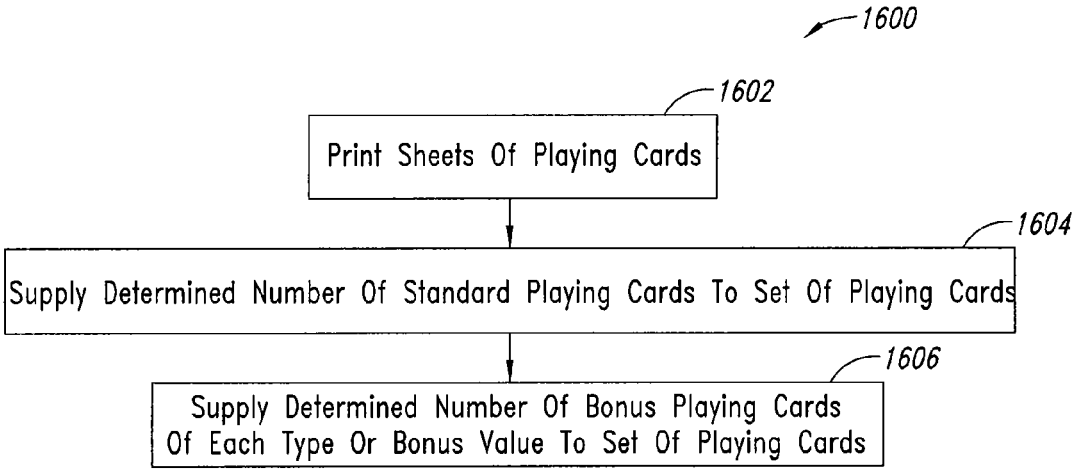
FIG. 16 is a flow diagram illustrating a method of forming sets of playing cards based at least in part on the determined composition, according to one illustrated embodiment.

FIG. 16 shows a method 1600 of forming sets of playing cards 120 based on a determined composition. The method 1600 maybe suitable for use in the method 800 (FIG. 8).

At 1602, the playing card manufacturer 102 prints or otherwise forms sheets 118 of standard and bonus playing cards 200, 300, 400, and 500. At 1604, the playing card manufacturer 102 supplies the determined number of standard playing cards 200 to the set of playing cards 120. At 1606, the playing card manufacturer 102 supplies the determined number of bonus playing cards 300, 400, 500 of each type or bonus value 302, 402, 502 to the set of playing cards 120.

Gaming Environment

Figure 17:
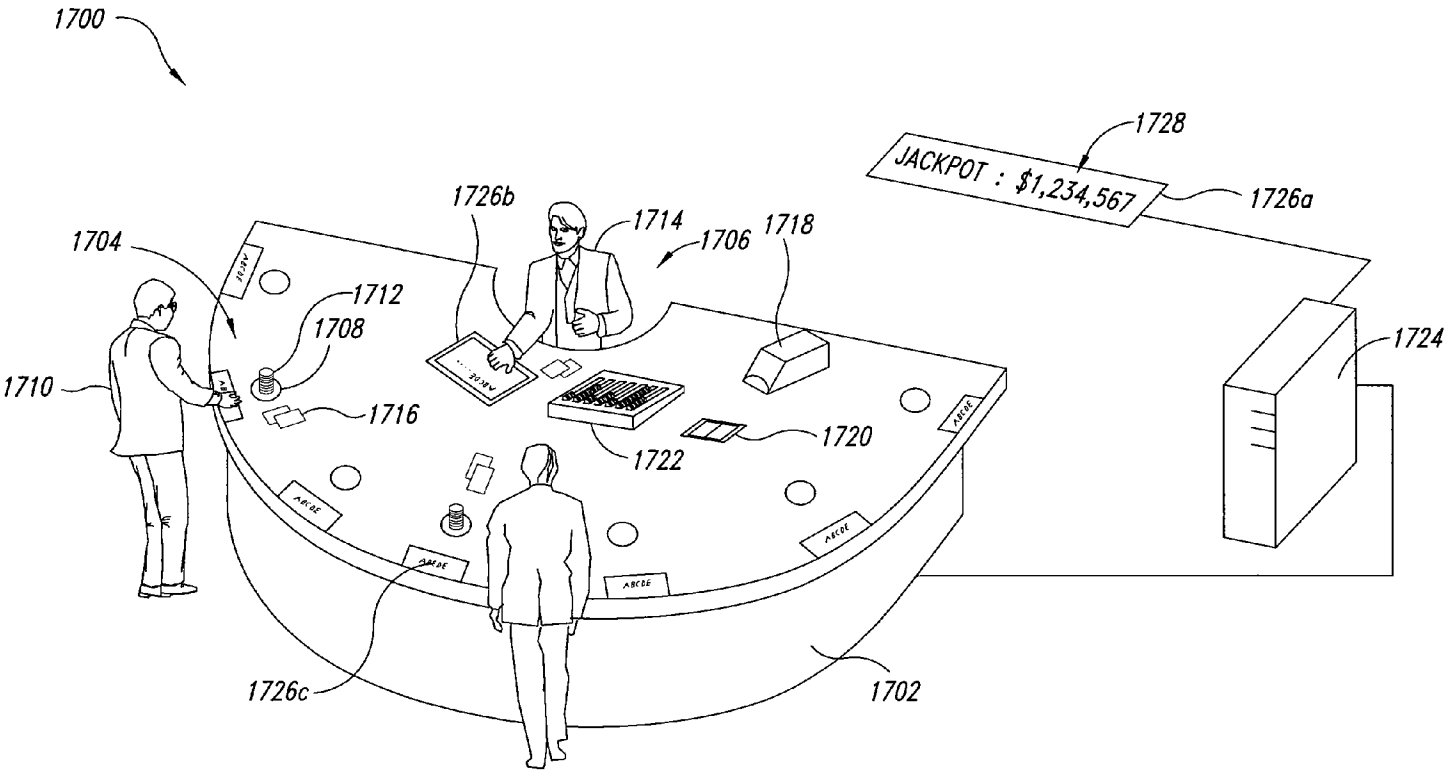
FIG. 17 is an isometric view of a gaming environment in which the set of playing cards may be used, according to one illustrated embodiment.

FIG. 17 shows a gaming environment 1700 according one illustrated embodiment.

The gaming environment 1700 includes one or more gaming tables 1702 having a number of player positions 1704 (only one called out in Figure) and a dealer position 1706. The player positions 1704 are typically associated with a wagering area demarcated on the playing surface of the gaming table 1702 and commonly referred to as a betting circle 1708 (only one called out in Figure). A player 1710 (only one called out in Figure) places a bet or wager by locating one or more chips 1712 or other items of value in the betting circle 1708.

A dealer 1714 deals playing cards 1716 to the players 1710. In some games, the dealer 1714 may deal playing cards to the dealer's own self. The dealer 1714 may deal playing cards 1716 from a handheld deck or from a card shoe 1718. The dealer 1714 may retrieve the playing cards 1716 from a playing card handling system 1720, for example, an automatic shuffling machine. The dealer 1714 may load the retrieved playing cards 1716 into the card shoe 1718, if the card shoe 1718 is present on the gaming table 1702. The dealer 1714 uses a chip tray 1722 for storing wagers collected from losing players 1710 and for paying out winnings to winning players 1710.

The gaming environment 1700 may also include a gaming environment computing system 1724 and one or more displays 1726*a*, 1726*b*, 1726*c* (collectively 1726). The gaming environment computing system 1724 is communicatively coupled to one or more systems and subsystems at the gaming table 1702, and to the displays 1726*a*, 1726*b*, 1726*c*. The gaming environment computing system 1724 may, for example, control or provide information to the displays 1726*a*, 1726*b*, 1726*c* for displaying information about the game being played at the gaming table 1702. For example, the gaming environment computing system 1724 can cause the displays 1726*a*, 1726*b*, 1726*c* to display a table identifier that identifies the gaming table 1702. The gaming environment computing system 1724 may also display information about the various player positions 1704. For example, the gaming environment computing system 1724 can cause the displays 1726*a*, 1726*b*, 1726*c* to display a status indication of the player position 1704. For example, the displays 1726*a*, 1726*b*, 1726*c* may display information indicating that a player position 1704 is open or is not currently open. The gaming environment computing system 1724 can cause the displays 1726*a*, 1726*b*, 1726*c* to display information regarding a bonus jackpot. For example, the gaming environment computing system 1724 can cause the displays 1726*a*, 1726*b*, 1726*c* to display a current amount of the bonus jackpot 1728, amount of time since the bonus jackpot has been won, amount of time until the next bonus jackpot will be awarded, and/or the composition of the hand or hands that have come the closest to winning the bonus jackpot.

One or more of the displays 1726*a* may be in the line of sight or otherwise visible from one or more of the player positions 1704, dealer positions 1706, and/or viewable by other patrons either proximate or remote from the gaming table 1702, for example visible to patrons in other areas of the gaming premises. One or more of the displays 1726*b* may be in the line of sight or otherwise visible from the dealer position 1706. Some embodiments may only include a display 1726*b* visible from the dealer position 1706, and may include a shield, polarizing filter or other features that prevent the players 1710 from seeing the information displayed on the display 1726*b* visible from the dealer position 1706. One or more displays 1726*c* (only one called out in the Figure) may be positioned proximate respective ones of the player positions 1704.

One or more displays 1726 may provide an input interface for the dealer 1714. For example, the display 1726*b* may take the form of a touch sensitive display, presenting a graphical user interface (GUI) with one or more user selectable icons. The display 1726*b* may be positioned within reach (e.g., within approximately 3 feet) of the dealer position 1706. Such may allow the dealer 1714 to enter information regarding the game in general or to enter information regarding each of the respective player positions 1704. For example, the dealer 1714 may enter buy-in amounts.

One or more displays 1726 may provide an input interface for the players 1710. For example, the displays 1726*c* may take the form of touch screen displays presenting a GUI with user selectable icons. The user selectable icons may allow the players 1710 to enter a player identifier to qualify for complimentary benefits ("comps"), to request services such as food or beverages, or to electronically access additional funds via credit or debit card information. Alternatively, or additionally, other user input devices may be employed, for example, keypads and/or keyboards. Some of the player 1710 related information may be displayed on the display 1726*b* viewable by the dealer 1714. In other embodiments, some of the player 1710 related information may be kept secret from the dealer 1714 as well as from the other players 1710.

The gaming environment 1700 may additionally include one or more sensor systems to sense wagers and/or other events occurring at the gaming table 1702. For example, one or more sensors may detect wagers. For instance, one or more imagers or cameras may be positioned in or under the chip tray 1722 to capture images of the betting circles 1708, as discussed in U.S. Pat. Nos. 6,712,696; 6,520,857; 6,517,436; 6,530,836; and 6,579,180. Also for instance, one or more antenna may be positioned in or under the chip tray 1722 to capture RF information from chips 1712 in the betting circles 1708. Also for example, one or more sensors may be located in or proximate the card shoe 1718 to detect the order in which playing cards 1716 are dealt to the participants (e.g., players 1710 and/or dealer 1714). Additionally, or alternatively, one or more sensors may be located in or proximate a discard receiving portion of the card handling system 1720 to detect playing cards collected from the participants (e.g., players 1710 and/or dealer 1714). For instance one or more imagers or cameras may be positioned in or proximate the card shoe 1718 or discard portion of the card handling system 1720, as discussed in U.S. Pat. Nos. 6,460,848; 6,595,857; 6,685,568; 6,857,961; and 6,964,612. Additionally, or alternatively, one or more sensors may be located in or proximate the chip tray 1722 to determine the contents of the chip tray 1722. For instance, one or more imagers may be located in or proximate the chip tray 1722 to capture images of the contents of the chip tray 1722 as discussed in U.S. Pat. Nos. 6,712,696; 6,579,181; and 6,517,435. Also for instance, one or more antennas may be located in or proximate the chip tray 1722 to interrogate the contents of the chip tray 1722.

Thus, various sensors may be employed to detect information from each chip 1712 and/or each playing card 1716 to identify the chip 1712 and/or playing card 1716. The sensors may collect information via images (visible, infrared, ultraviolet), radio or microwave electromagnetic radiation, and/or by detecting magnetic, inductance, or mechanical energy. Such may be implemented in the card shoe 1718, chip tray 1722, or other areas at or proximate the gaming table 1702. For example, one embodiment employs machine-readable symbol reader systems such as a bar code reader system to read machine-readable symbols such as bar code information printed on each chip 1712 and/or each playing card 1716 (typically using a non-visible medium such as ultraviolet sensitive ink or the like). Alternatively, or additionally, machine-readable symbol reader systems may read standard markings from the playing cards 1716, such as rank symbols, suit symbols, and/or pips. Another embodiment employs radio frequency identification (RFID) interrogators to read identifying information from RFID transponders in each chip 1712 and/or playing card 1716. A further embodiment employs magnetic stripe readers. Other types of sensors are possible, such as those used in electronic article surveillance (EAS).

A plurality (e.g., four) of gaming tables 1702 may be organized as a pit, and may or may not share a common display 126*a* and/or gaming environment computing system 1724. Thus, the display 1726*a* may be viewable by some or all of the players 1710 at the various gaming tables 1702. The display 1726*a* may be viewable by other patrons of the casino. Such may advantageously create excitement amongst the patrons. Such also advantageously allows pit bosses or other casino personnel to easily keep track of the payout or house odds selected by the players 1710 in the various player positions 1704 at multiple gaming tables 1702.

Figure 18:
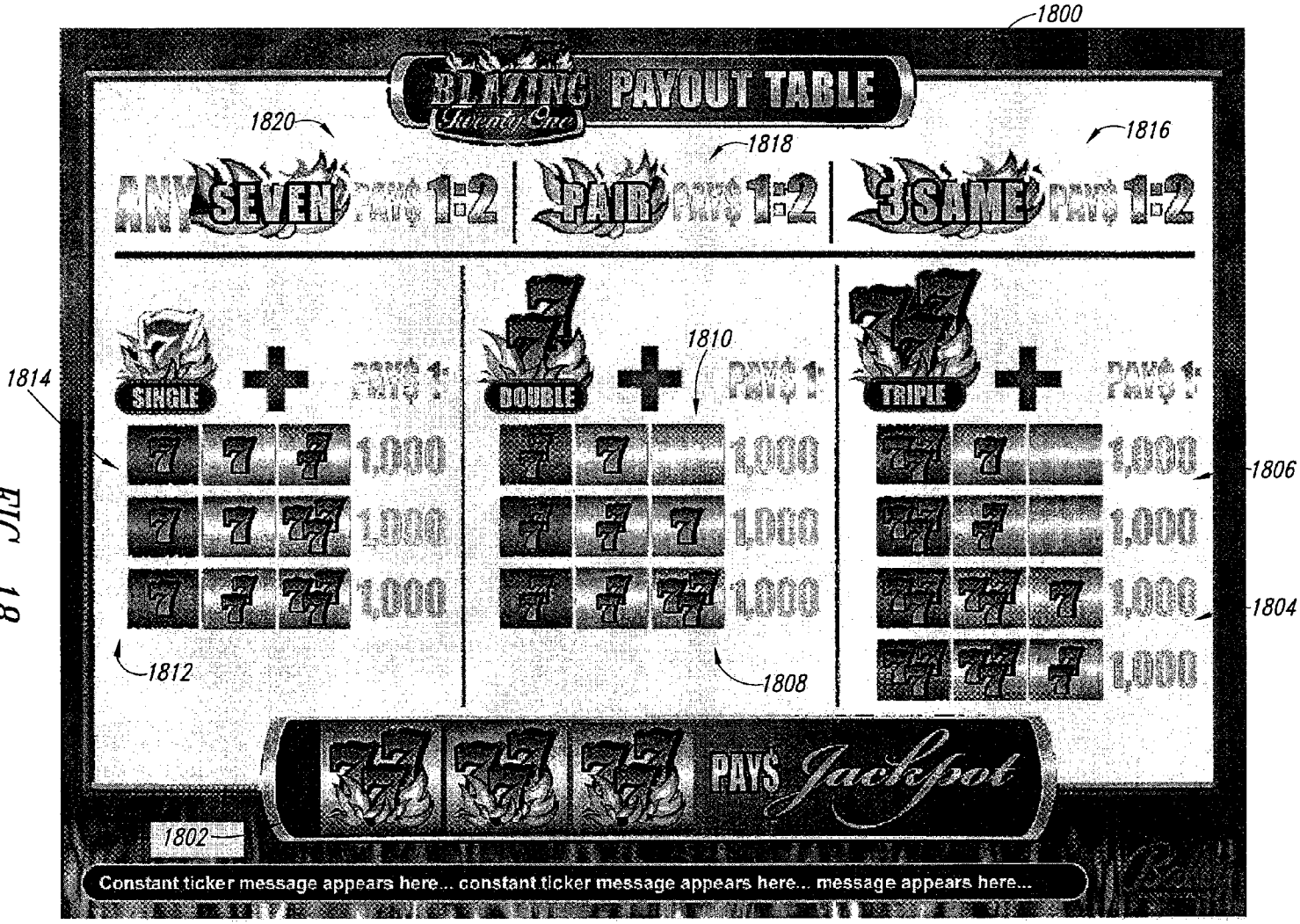
FIG. 18 is front plan view of a display of a bonus payout table, according to one illustrated embodiment.

FIG. 18 shows a bonus payout table 1800, according to one illustrated embodiment.

The bonus payout table 1800 is based on the inclusion of three types of bonus playing cards (e.g., 300, 400, 500 of FIGS. 3, 4, and 5), each type associated with a respective bonus value. A first bonus value corresponds to a triple bonus value (e.g., 777), a second bonus value corresponds to a double bonus value (e.g., 77), and a third bonus value corresponds to a single bonus value (e.g., 7). The bonus playing cards 300, 400, 500 all have the same rank, which is selected from the standard playing card ranks. In the illustrated embodiment, the rank is equal to 7. In some embodiments, the set of playing cards 120 may omit the standard playing cards 200 that have the same rank as the bonus playing cards 300, 400, 500. This prevents the inclusion of the bonus playing cards 300, 400, 500 from effecting the odds of the underlying card game. It is noted that a smaller or greater number of bonus playing cards may be employed. It is also noted that bonus playing cards with ranks other than 7 may be employed and/or bonus playing cards with more than one rank may be employed. It is further noted that bonus playing cards with a smaller or greater number of bonus values may be employed.

As the payout table 1800 indicates at 1802, any player hand including three bonus playing cards of the first bonus value is paid the bonus jackpot. As the payout table 1800 indicates at 1804, any player hand including two bonus playing cards of the first bonus value along with one bonus playing card of either the second or the third bonus values is paid at 1:1000 (e.g., pays $1000 for every $1 wagered). As the payout table 1800 indicates at 1806, any player hand including one bonus playing card of the first bonus value along with one bonus playing card of either the second or the third bonus values is paid at 1:1000.

As the payout table 1800 indicates at 1808, any player hand including two bonus playing cards of the second bonus value along with one bonus playing card of either the first or the third bonus values is paid at 1:1000. As the payout table 1800 indicates at 1810, any player hand including one bonus playing card of the second bonus value along with one bonus playing card of the third bonus values is paid at 1:1000.

As the payout table 1800 indicates at 1812, any player hand including one bonus playing card of each of the first, the second and the third bonus values is paid at 1:1000. As the payout table 1800 indicates at 1814, any player hand including two bonus playing cards of the third bonus value along with one bonus playing card of either the first or the second bonus values is paid at 1:1000.

As the payout table 1800 indicates at 1816, any player hand including three bonus playing cards of a kind (e.g., three with same bonus value) is paid at 1:2 (e.g., pays $2 for every $1 wagered). As the payout table 1800 indicates at 1818, any player hand including a pair of bonus playing cards (e.g., two with same bonus value) is paid at 1:2. As the payout table 1800 indicates at 1820, any player hand including a single bonus playing card of a kind is paid at 1:2.

Figure 19:
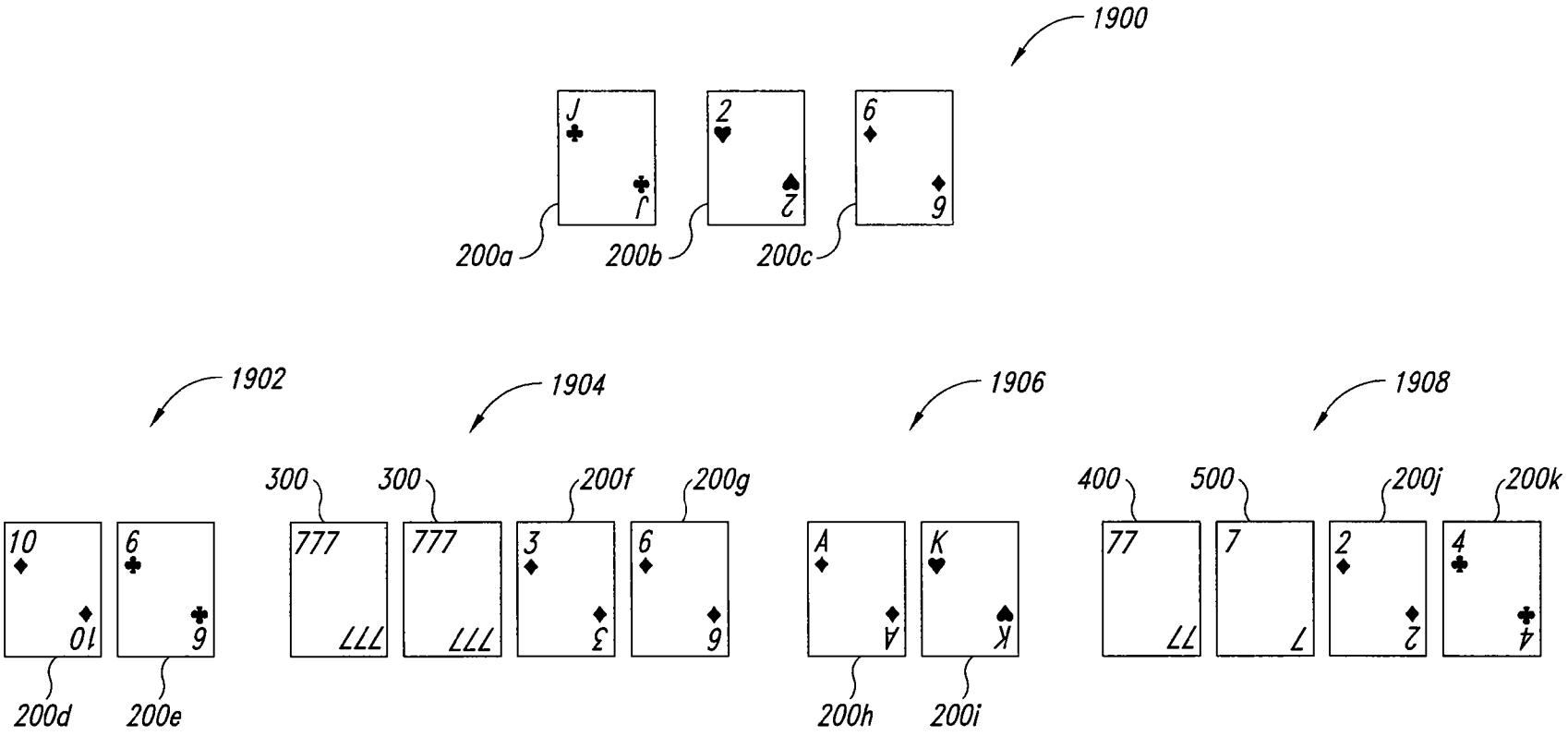
FIG. 19 is top, plan view of a dealer's hand and four (4) player's hands, illustrating a method of resolving wagers, according to one illustrated embodiment.

FIG. 19 shows an exemplary dealer's hand 1900 and four (4) player's hands 1902, 1904, 1906, 1908, according to one illustrated embodiment. The hands may of course contain a greater or smaller number of playing cards, and may include different playing cards than illustrated. FIG. 19 is illustrative of how an exemplary blackjack card game may be resolved, with a particular bonus structure. The teachings herein are applicable to other card games (e.g., baccarat, poker, PIA GOW POKER, CARIBBEAN STUD POKER, etc.). While denominated below as first, second, third and fourth player's hands 1902, 1904, 1906, 1908, respectively, the hands may be held by less than four players, and could be held by a single player, or perhaps by two players who have each split their hands.

The dealer's hand 1900 includes three standard playing cards 200*a*-200*c*, with ranks J, 2 and 6, having a cumulative total of 18.

A first player's hand 1902 includes two standard playing cards 200*d*, 200*e* with ranks 10 and 6, having a cumulative total of 16. As such, the first player's hand loses to the dealer's hand 1900, since the cumulative total of the dealer's hand 1900 is closer to twenty-one without exceeding twenty-one. Since the first player's hand 1902 is a loss to the player, the first player's hand does not qualify for the bonus.

A second player's hand 1904 includes two bonus playing cards 300 of the first bonus value with ranks equal to 7, and two standard playing cards 200*f*, 200*g* with ranks 3 and 6, respectively. The second player's hand has a cumulative total of 23. The second player's hand is a loss for the player since the total exceeds twenty-one, thus constitutes a "bust". Since the second player's hand 1904 is a loss to the player, the second player's hand 1904 does not qualify for the bonus. Had the second player's hand 1904 won based on the rules of the underlying card game (e.g., blackjack), the second player's hand 1904 would have received a bonus amount of 1:2 under the bonus payout table 1800.

A third player's hand 1906 includes two standard playing cards 200*h*, 200*i* having ranks A and K, respectively, having a cumulative total of twenty-one, and is a blackjack. The third player's hand 1906 beats the dealer's hand 1900, and is a win for the player. The third player's hand 1906 qualifies for the bonus, however does not contain any bonus playing cards. Thus, the third player's hand 1906 does not receive any bonus amount under the bonus payout table 1800.

A fourth player's hand 1908 includes two bonus playing cards with ranks equal to 7, and two standard playing cards with ranks 2 and 5. The fourth player's hand 1908 has a cumulative total of 20. The fourth player's hand 1908 beats the dealer's hand 1900, and is a win for the player. The fourth player's hand 1908 qualifies for the bonus, and contains bonus playing cards of a single bonus value and a double bonus value. Thus, the fourth player's hand 1908 receives a bonus amount of 1:1000 (e.g., pays $1000 for every $1 wagered) under the bonus payout table 1800.

Resolving Wagers in Gaming Environment

Figure 20:
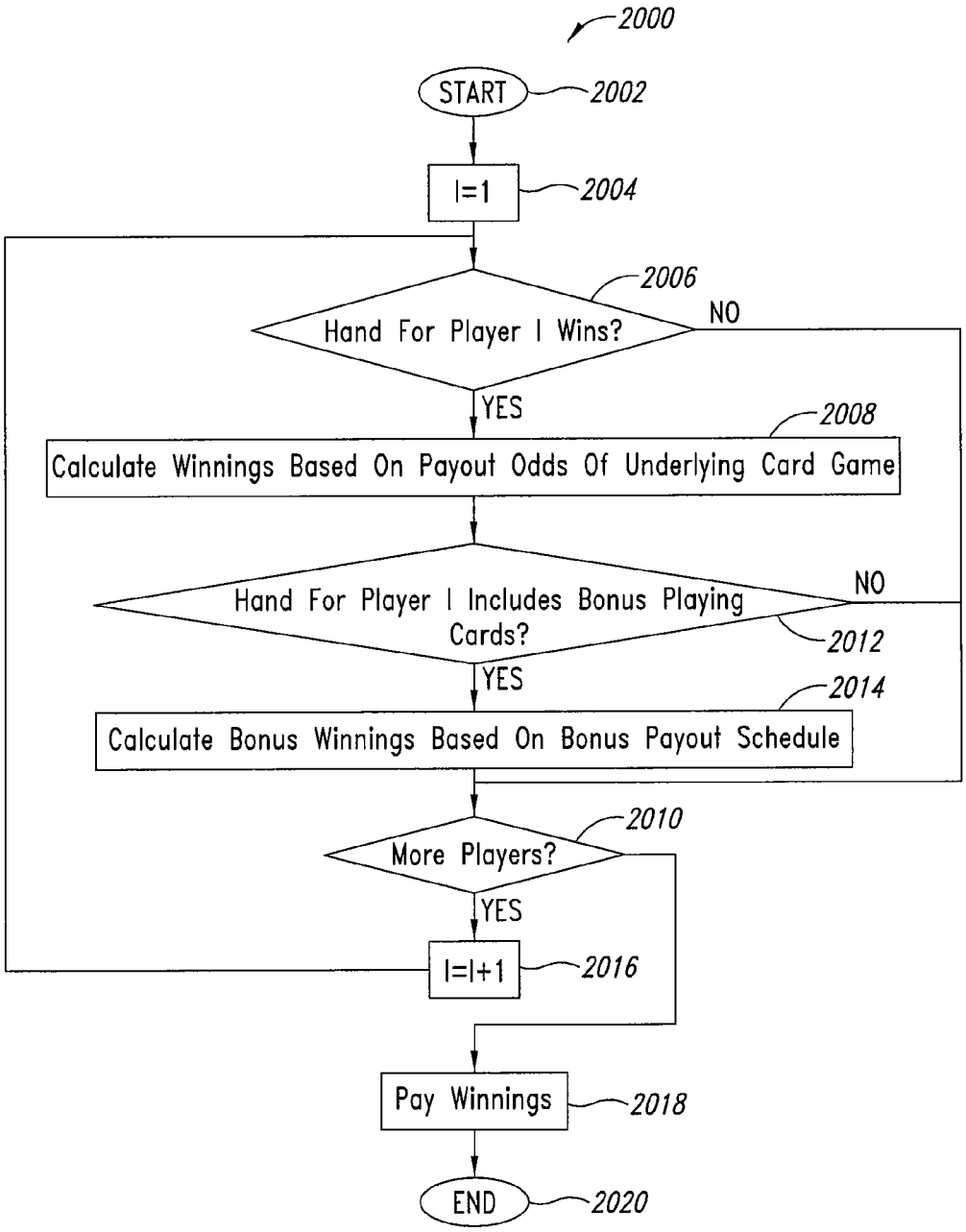
FIG. 20 is a flow diagram illustrating a method of resolving wagers, according to one illustrated embodiment.

FIG. 20 shows a method 2000 of resolving wagers employing the payout table 1800 (FIG. 18), according to one illustrated embodiment. The method 2000 may be automatically implemented by the gaming environment computing system 1724, or by other systems. In some embodiments, portions or all of the method 2000 may be manually implemented.

The method 2000 starts at 2002. For example, the method 2000 may start in response to the end of one hand or round of a card game.

At 2004, a player variable I is set, for example equal to 1. At 2006, the gaming environment computing system 1724 determines whether the hand for the player I has won under the rules of the underlying card game (e.g., blackjack, baccarat, poker, PIA GOW POKER, CARIBBEAN, STUD POKER). If the hand has won, control passes to 2008, and if the hand has lost, control passes to 2010.

At 2008, the gaming environment computing system 1724 calculates the winnings for the hand based on the payout table or rules of the underlying card game. For example, in blackjack a player with a blackjack is paid at 3:2, while other winning hands are paid 1:2, and ties or pushes are not paid.

At 2012, the gaming environment computing system 1724 determines whether a winning hand includes bonus playing cards. If the winning hand includes bonus playing cards, control passes to 2014. If the winning hand does not include bonus playing cards, control passes to 2010.

At 2014, the gaming environment computing system 1724 calculates the bonus winnings based on the bonus payout schedule 1800.

At 2010, the gaming environment computing system 1724 determines whether there are more players or hands. If there are more players or hands, the gaming environment computing system 1724 increments the player count I at 2016, and returns control to 2006 to analyze the next hand.

If there are no more players or hands, the gaming environment computing system 1724 may optionally cause payment of the determined winnings at 2018. In some embodiments, the gaming environment computing system 1724 may provide a suitable indication to a dealer or other casino personnel to pay the winnings. In other embodiments, the gaming environment computing system 1724 may automatically credit a player's account with the winnings. The method 2000 then terminates at 2020.

Figure 21:
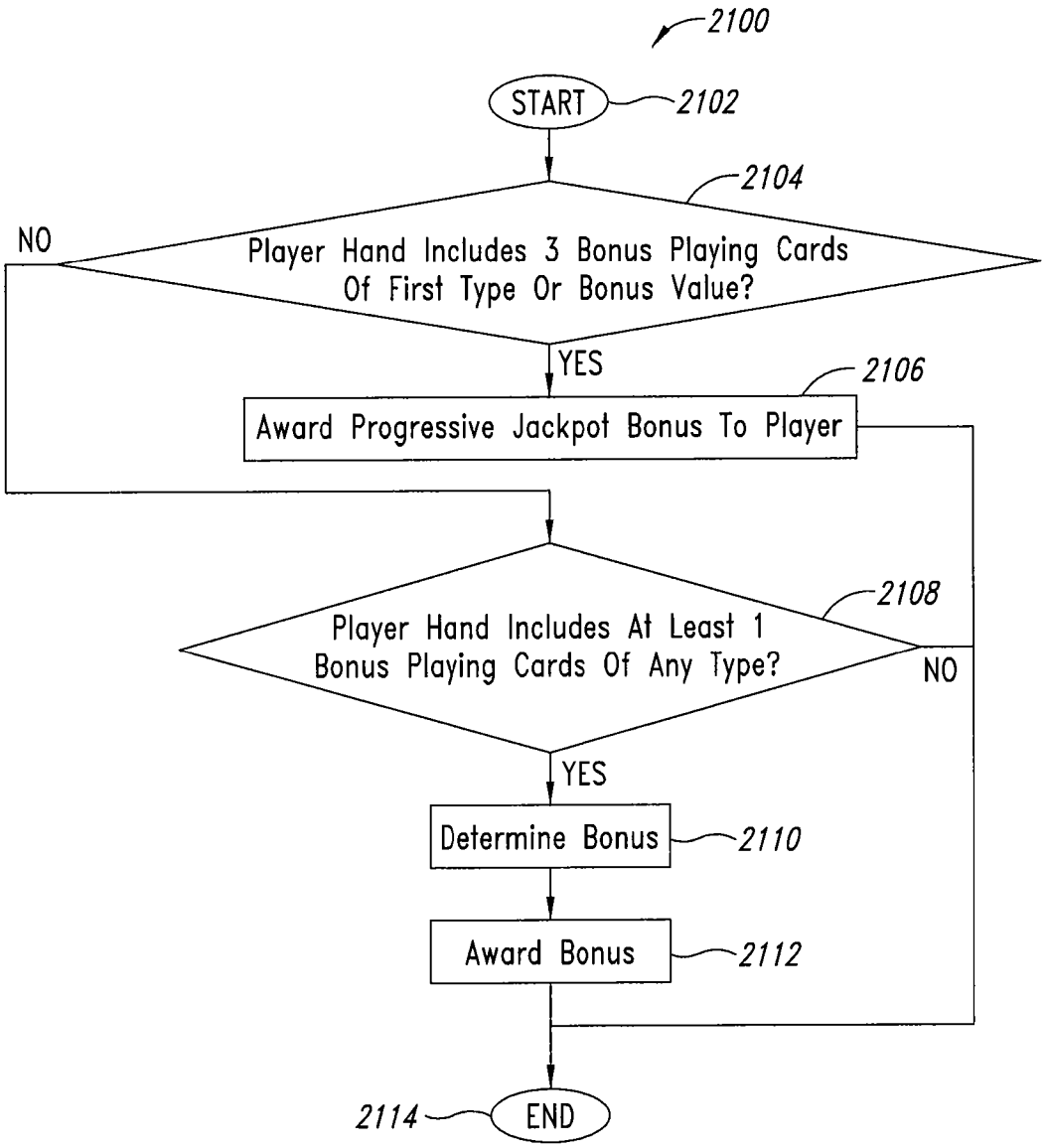
FIG. 21 is a flow diagram illustrating a method of resolving a bonus portion of a card game, according to one illustrated embodiment.

FIG. 21 shows a method 2100 of resolving bonuses according to one illustrated embodiment. The method 2100 may be suitable for use in the method 2000 (FIG. 20).

The method 2100 starts at 2102. For example, the method 2100 may be executed by the gaming environment computing system 1724 to calculate the bonus winnings 2014 (FIG. 20).

At 2104, the gaming environment computing system 1724 determines if the player's hand includes three bonus playing cards 300 (FIG. 3) of the first type or bonus value. If the player's hand includes three bonus playing cards 300 of the first type or bonus value, a progressive jackpot bonus is awarded at 2106. If the player's hand does not include three bonus playing cards 300 of the first type or bonus value, control passes to 2108.

At 2108, the gaming environment computing system 1724 determines if the player's hand includes at least one bonus playing card of any type 300, 400, 500 (FIGS. 3, 4, and 5). If the player's hand includes at least one bonus playing card 300, 400, 500 of any type, the gaming environment computing system 1724 determines the amount of the non-jackpot bonus at 2110. At 2112, the gaming environment computing system 1724 awards the non-jackpot bonus. The method 2100 terminates at 2114.

Figure 22A:
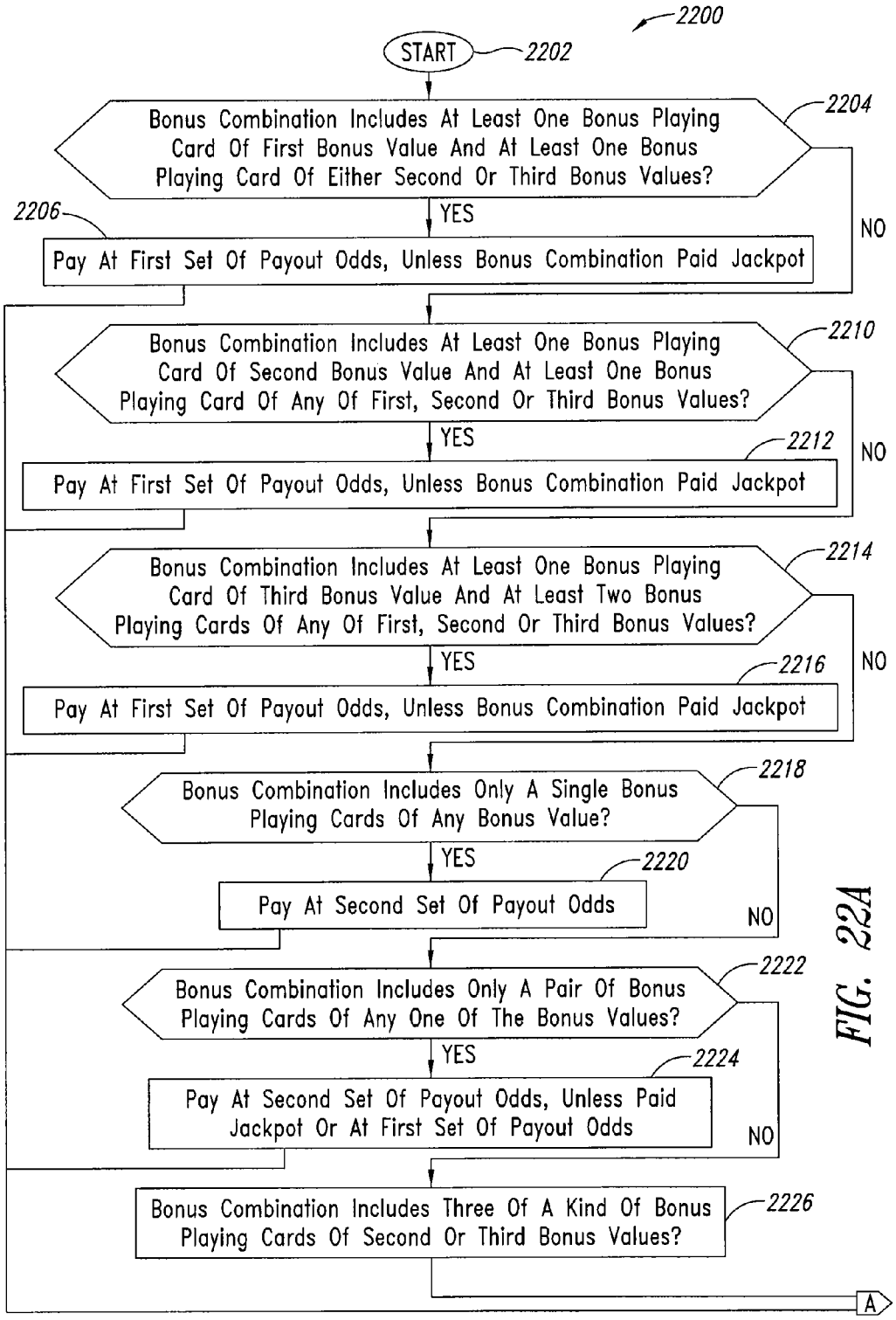
FIGS. 22A and 22B are a flow diagram illustrating a method of determining a bonus payout other than a jackpot bonus payout, according to one illustrated embodiment.
Figure 22B:
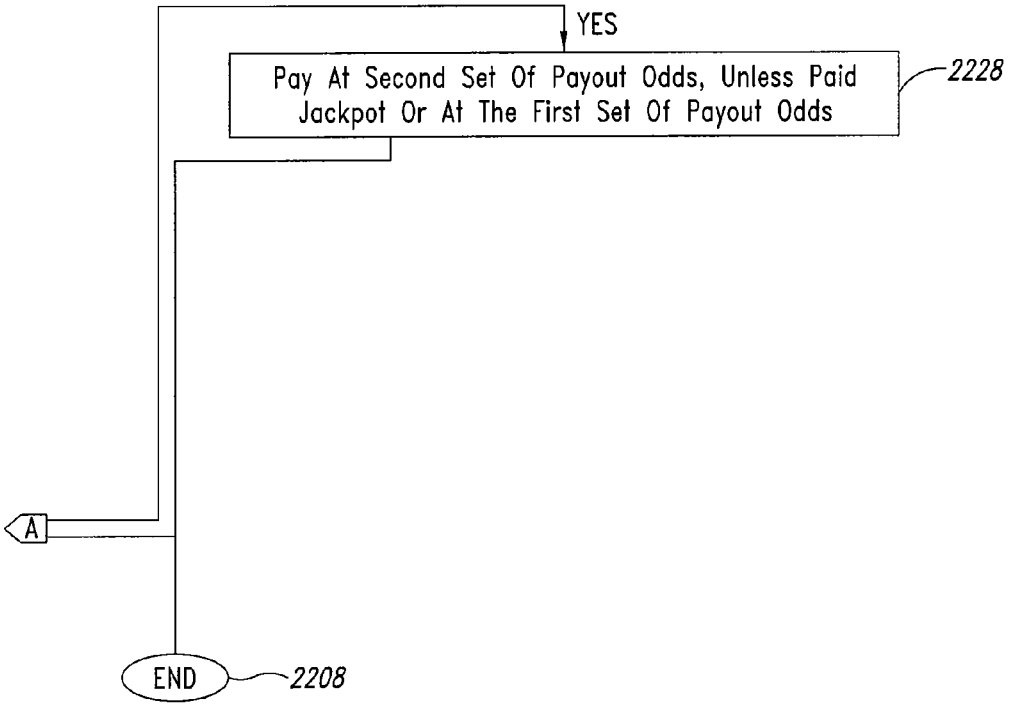

FIGS. 22A and 22B show a method 2200 of determining the bonus, according to one illustrated embodiment. The method 2200 may be suitable for use in the method 2100 (FIG. 21).

The method 2200 starts at 2202. For example, the method 2200 may start in response to a call at 2114 of the method 2100.

At 2204, the gaming environment computing system 1724 determines whether a bonus combination includes at least one bonus playing card 300 (FIG. 3) of the first bonus value and at least one bonus playing card of either the second or third bonus values 400, 500 (FIGS. 4 and 5). If the bonus combination includes at least one bonus playing card 300 of the first bonus value and at least one bonus playing card of either the second or third bonus values 400, 500, control passes to 2206. If not, control passes to 2210.

At 2206, the gaming environment computing system 1724 determines that the payout is at a first set of payout odds, unless the bonus combination was entitled to the jackpot bonus. Control then passes to 2208 where the method 2200 terminates.

At 2210, the gaming environment computing system 1724 determines whether the bonus combination includes at least one bonus playing card 400 (FIG. 4) of the second bonus value and at least one bonus playing card 300, 400, 500 of any of the first, second, or third bonus values (FIGS. 3, 4, and 5). If the bonus combination includes at least one bonus playing card 400 of the second bonus value and at least one bonus playing card 300, 400, 500 of any of the first, second, or third bonus values, control passes to 2212. If not, control passes to 2214.

At 2212, the gaming environment computing system 1724 determines that the payout is at the first set of payout odds, unless the bonus combination was entitled to the jackpot bonus. Control then passes to 2208 where the method 2200 terminates.

At 2214, the gaming environment computing system 1724 determines whether the bonus combination includes at least one bonus playing card 500 (FIG. 5) of the third bonus value and at least two bonus playing cards 300, 400, 500 of any of the first, second, or third bonus values (FIGS. 3, 4, and 5). If the bonus combination includes at least one bonus playing card 500 of the third bonus value and at least two bonus playing cards 300, 400, 500 of any of the first, second, or third bonus values, control passes to 2216. If not, control passes to 2218.

At 2216, the gaming environment computing system 1724 determines that the payout is at the first set of payout odds, unless the bonus combination was entitled to the jackpot bonus. Control then passes to 2208 where the method 2200 terminates.

At 2218, the gaming environment computing system 1724 determines whether the bonus combination includes only a single bonus playing card 300, 400, 500 (FIGS. 3, 4, and 5) of any bonus value. If the bonus combination includes only a single bonus playing card 300, 400, 500, control passes to 2220. If not, control passes to 2222.

At 2220, the gaming environment computing system 1724 determines that the payout is at a second set of payout odds, different from the first set of payout odds, unless the bonus combination was entitled to the jackpot bonus. Control then passes to 2208 where the method 2200 terminates.

At 2222, the gaming environment computing system 1724 determines whether the bonus combination includes only a pair of bonus playing cards 300, 400, 500 (FIGS. 3, 4, and 5) of any one of the bonus values. If the bonus combination includes only a pair of bonus playing cards 300, 400, 500, control passes to 2224. If not, control passes to 2226.

At 2224, the gaming environment computing system 1724 determines that the payout is at a second set of payout odds, unless the bonus combination was entitled to the jackpot bonus. Control then passes to 2208 where the method 2200 terminates.

At 2226, the gaming environment computing system 1724 determines whether the bonus combination includes three of a kind of bonus playing cards 400, 500 (FIGS. 4 and 5) of a second or third bonus value. If the bonus combination includes three of a kind of bonus playing cards 400, 500, control passes to 2228. If not, control passes to 2208 where the method 2200 terminates.

At 2228, the gaming environment computing system 1724 determines that the payout is at a second set of payout odds, unless the bonus combination was entitled to the jackpot bonus.

The above description of illustrated embodiments, including what is described in the Abstract, is not intended to be exhaustive or to limit the embodiments to the precise forms disclosed. Although specific embodiments and examples are described herein for illustrative purposes, various equivalent modifications can be made without departing from the spirit and scope of the disclosure, as will be recognized by those skilled in the relevant art. The teachings provided herein of the various embodiments can be applied to other playing card environments, not necessarily the exemplary networked playing card order and distribution environment 100 generally described above.

For instance, the foregoing detailed description has set forth various embodiments of the devices and/or processes via the use of block diagrams, schematics, and examples. Insofar as such block diagrams, schematics, and examples contain one or more functions and/or operations, it will be understood by those skilled in the art that each function and/or operation within such block diagrams, flowcharts, or examples can be implemented, individually and/or collectively, by a wide range of hardware, software, firmware, or virtually any combination thereof. In one embodiment, the present subject matter may be implemented via Application Specific Integrated Circuits (ASICs). However, those skilled in the art will recognize that the embodiments disclosed herein, in whole or in part, can be equivalently implemented in standard integrated circuits, as one or more computer programs running on one or more computers (e.g., as one or more programs running on one or more computer systems), as one or more programs running on one or more controllers (e.g., microcontrollers) as one or more programs running on one or more processors (e.g., microprocessors), as firmware, or as virtually any combination thereof, and that designing the circuitry and/or writing the code for the software and or firmware would be well within the skill of one of ordinary skill in the art in light of this disclosure.

In addition, those skilled in the art will appreciate that the mechanisms taught herein are capable of being distributed as a program product in a variety of forms, and that an illustrative embodiment applies equally regardless of the particular type of computer-readable media used to actually carry out the distribution. Examples of computer-readable media include, but are not limited to, the following: recordable type media such as floppy disks, hard disk drives, CD ROMs, digital tape, and computer memory; and transmission type media such as digital and analog communication links using TDM or IP based communication links (e.g., packet links). The computer-readable medium can additionally or alternatively take the form of an electronic, magnetic, optical, electromagnetic, infrared, or semiconductor system, apparatus, device, or propagation medium. More specific examples (a nonexhaustive list) of the computer-readable medium include the following: an electrical connection having one or more wires, a portable computer diskette (magnetic, compact flash card, secure digital, or the like), a random access memory (RAM), a read-only memory (ROM), an erasable programmable read-only memory (EPROM, EEPROM, or Flash memory), an optical fiber, and a portable compact disc read-only memory (CDROM). Note that the computer-readable medium could even be paper or another suitable medium upon which the program associated with logic and/or information is printed, as the program can be electronically captured, via for instance optical scanning of the paper or other medium, then compiled, interpreted or otherwise processed in a suitable manner, if necessary, and then stored in memory.

In particular, FIGS. 8-16 and 20-22 are flow diagrams that show the architecture, functionality, and operation of a possible implementation of software for implementing a logic. In this regard, each block may represent a module, segment, or portion of code, which comprises one or more executable instructions for implementing the specified logical function(s). It should also be noted that in some alternative implementations, the functions noted in the blocks may occur out of the order noted in FIGS. 8-16 and 20-22, may omit some functions, and/or may include additional functions. For example, some blocks shown in succession may in fact be executed substantially concurrently, the blocks may sometimes be executed in the reverse order, or some of the blocks may not be executed in all instances, depending upon the functionality involved. Furthermore, some blocks of one of the flow diagrams of FIGS. 8-16 and 20-22 may be interchanged with the blocks of one of the other flow diagrams, and/or may be added to one of the other flow diagrams. All such modifications and variations are intended to be included herein within the scope of this disclosure.

As used herein and in the claims, the term "random" includes pseudo-random and the like, which are sufficiently random to meet an applicable criteria, for example criteria set by a governmental or quasi-governmental gambling authority.

The various embodiments described above can be combined to provide further embodiments. All of the above U.S. patents, patent applications, provisional patent applications and publications referred to in this specification, to include, but not be limited to, commonly assigned U.S. Provisional Application No. 60/838,280, filed Aug. 17, 2006; U.S. patent application Ser. Nos. 11/437,590, filed May 19, 2006; and Ser. No. 11/428,264, filed Jun. 30, 2006 are incorporated herein by reference in their entirety. Aspects of the invention can be modified, if necessary, to employ various systems, devices, and concepts of the various patents, applications, and publications to provide yet further embodiments of the invention.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A system to form sets of physical playing cards, the system comprising:

an input subsystem comprising at least one input device that includes a user interface incorporating elements to receive user input indicative of;

a desired theoretical hold of a plurality of card games including at least a first card game having a first set of rules and a second card game conducted contingent upon a player achieving a successful outcome in the first card game and having a second set of rules, the plurality of card games played using playing cards drawn from a set of playing cards;

the first set of rules and the second set of rules used in the plurality of card games played using the set of playing cards; and a progressive jackpot parameter indicative of a portion of each wager on the card game that funds a progressive jackpot winnable by one or more players playing the card game;

a processing subsystem comprising at least one processor and processor-readable nontransitory storage medium communicably coupled to the at least one card printer interface and to the at least one input device that, in operation, automatically determines a composition of each printed set of physical playing cards based at least in part on the received input, each printed set of physical playing cards including both a number of standard playing cards used in determining an outcome of the first card game and a number of bonus playing cards used in determining the outcome of the first card game and an outcome of the second card game; and at least one card printer interface that, in operation, provides one or more output signals to a communicably coupled playing card printer that prints each set of physical playing cards based on the composition of the respective set of physical playing cards determined by the at least one processor.

2. The system of claim 1 wherein the at least one processor automatically determines a composition of each printed set of physical playing cards by determining a total number of bonus playing cards to include in each printed set of physical playing cards based at least in part on the desired theoretical hold of the first card game and the second card game both the first card game and the second card game played using playing cards drawn from each printed set of physical playing cards, the first set of rules, the second set of rules and the progressive jackpot parameter.

3. The system of claim 1 wherein the at least one processor automatically determines a composition of each printed set of physical playing cards by determining a total number of each of at least two types of bonus playing cards to include in each printed set of physical playing cards to achieve the desired theoretical hold.

4. The system of claim 1 wherein the at least one processor automatically determines a composition of each printed set of physical playing cards by determining a total number of each of at least three types of bonus playing cards to include in each printed set of physical playing cards to achieve the desired theoretical hold.

5. The system of claim 1 wherein each of the bonus playing cards has a rank selected from a standard set of ranks, and the at least one processor automatically determines a composition of each printed set of physical playing cards by determining a total number of each of at least three types of bonus playing cards to include in each printed set of physical playing cards to achieve the desired theoretical hold based at least in part on a theoretical hold of the first card game which is resolved at least in part on the ranks of both the standard playing cards and the bonus playing cards, and a theoretical hold of the second card game that is resolved at least in part on a respective bonus value ascribed to each of the bonus playing cards.

6. The system of claim 1 wherein each of the bonus playing cards has a rank selected from a standard set of ranks and has a bonus value independent of the rank, and the at least one processor automatically determines a composition of each printed set of physical playing cards by determining a total number of each of at least three types of bonus playing cards to include in each printed set of physical playing cards to achieve the desired theoretical hold based at least in part on a theoretical hold of the first card game which is resolved at least in part on the ranks of both the standard playing cards and the bonus playing cards, and a theoretical hold of the second card game that is resolved at least in part on a respective one of the bonus values ascribed to each of the bonus playing cards.

7. The system of claim 6 wherein the at least one processor automatically determines a composition of each printed set of physical playing cards by determining the total number of each of the at least three types of bonus playing cards to include in each printed set of physical playing cards to achieve the desired theoretical hold based at least in part on whether a push in the first card game is treated as an unsuccessful outcome for a player.

8. The system of claim 6 wherein the at least one processor automatically determines a composition of each printed set of physical playing cards by determining the total number of each of the at least three types of bonus playing cards to include in each printed set of physical playing cards to achieve the desired theoretical hold based at least in part on whether a push in the first card game whose outcome is determined using at least one bonus playing card in a player hand is treated as an unsuccessful outcome for a player.

9. The system of claim 6 wherein the at least one processor automatically determines a composition of each printed set of physical playing cards by determining the total number of each of the at least three types of bonus playing cards to include in each printed set of physical playing cards to achieve the desired theoretical hold based at least in part on a percentage of each wager allocated to a progressive bonus jackpot.

10. The system of claim 6 wherein the at least one processor automatically determines a composition of each printed set of physical playing cards by determining the total number of each of the at least three types of bonus playing cards to include in each printed set of physical playing cards to achieve the desired theoretical hold based at least in part on a starting amount of a progressive bonus jackpot.

11. The system of claim 1 wherein the at least one processor automatically determines a composition of the set of playing cards to include in each printed set of physical playing cards to determine a total number of each of at least three types of bonus playing cards to achieve the desired theoretical hold based at least in part on a total number of playing cards included in each printed set of physical playing cards.

* * * * *